US007817174B2

(12) United States Patent
Saitoh et al.

(10) Patent No.: US 7,817,174 B2
(45) Date of Patent: Oct. 19, 2010

(54) DIRECT IMAGE-RECORDING DEVICE AND IMAGE FORMING APPARATUS EQUIPPED THEREWITH

(75) Inventors: Masanori Saitoh, Tokyo (JP); Shin Kayahara, Kanagawa (JP); Masanori Horike, Kanagawa (JP); Osamu Endo, Kanagawa (JP); Tomoko Takahashi, Kanagawa (JP); Nobuaki Kondoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/603,794

(22) Filed: Oct. 22, 2009

(65) Prior Publication Data

US 2010/0104319 A1 Apr. 29, 2010

(30) Foreign Application Priority Data

Oct. 23, 2008 (JP) ..... 2008-273508

(51) Int. Cl.
*B41J 2/385* (2006.01)
*G03G 13/04* (2006.01)
*G03G 9/08* (2006.01)

(52) U.S. Cl. ..... 347/140; 347/155; 347/156; 399/111

(58) Field of Classification Search ..... 347/55, 347/140, 155–156, 158, 212, 101, 103; 399/55, 399/67, 110, 111, 119, 120, 237, 252, 262, 399/325, 339, 340, 341; 430/124.1, 124.21, 430/124.22

See application file for complete search history.

(56) References Cited

U.S. PATENT DOCUMENTS 5,629,726 A * 5/1997 Yamasa ..... 347/55
5,955,228 A 9/1999 Sakai et al.
6,030,069 A * 2/2000 Wakahara et al. ..... 347/55
6,398,345 B1 6/2002 Sakai et al.
7,689,145 B2 * 3/2010 Nakamura et al. ..... 399/110
2009/0041492 A1 2/2009 Horike et al.

FOREIGN PATENT DOCUMENTS

JP 2910019 4/1999
JP 2009-42500 2/2009

* cited by examiner

*Primary Examiner*—K. Feggins
(74) *Attorney, Agent, or Firm*—Oblon, Spivak, McClelland, Maier & Neustadt, L.L.P.

(57) ABSTRACT

A direct image-recording device in which a predetermined gap set between an image carrier and a hole forming member can be maintained, and an image forming apparatus provided with the direct image-recording device. In the direct image-recording device including: housing that accommodates an agent; an agent carrier that is rotatably supported by the housing and faces outside from an opening formed in the housing; a sheet-like hole forming member having a plurality of holes formed therein and facing the agent carrier at a predetermined distance therefrom; and a plurality of electrodes, by which the agent flies, provided at the hole forming member correspondingly to each of the plurality of holes and form an electric field causing the agent to fly selectively from the agent carrier toward the hole, a positioning member is provided at the housing so as to cover the agent carrier, the positioning member being configured to hold the hole forming member along the axial direction of the agent carrier by a side wall of the positioning member that has open portions formed in locations at least opposing the plurality of holes formed in the hole forming member, and configured to position the holes relative to the agent carrier so that the relative positions of the agent carrier and the holes are in a predetermined positional relationship.

12 Claims, 16 Drawing Sheets

DIRECT IMAGE-RECORDING DEVICE AND IMAGE FORMING APPARATUS EQUIPPED THEREWITH

BACKGROUND OF THE INVENTION

1. Field of the Invention

The present invention relates to a direct image-recording device and an image forming apparatus using same, such as a printer, a facsimile device, and a copier.

2. Description of the Related Art

A direct image-recording device in which an image is directly recorded on a recording paper or a transfer body has been known, this recording process being called toner jetting, direct toning, and toner projection. In such a direct image-recording device, a jetted-out image forming agent is caused to adhere directly to a recording paper and the image is directly formed on the recording paper or transfer body, without developing a latent image formed on a photosensitive body with an image forming agent such as a toner and transferring the developed image from the photosensitive body onto the recording paper or transfer body as in an electrophotographic process.

The conventional direct image-recording device is configured, for example, as disclosed in Japanese Patent No. 2,910,019, by a toner carrying roller that carries a charged toner on the surface thereof, a flexible printed substrate (FPC) serving as a hole forming member that has a plurality of holes formed therein, a plurality of ring-shaped jetting electrodes that are formed on the surface side opposite the toner carrying roller so as to surround the holes, and a counter electrode that faces the toner carrying roller below the flexible printed substrate (FPC). The recording paper is conveyed by a conveying means on the counter electrode.

The toner carrying roller is, for example, in a grounded state and carries on the surface a toner charged to a negative polarity. Where a jetting voltage of a positive polarity is applied to the jetting electrode, an electric field of a predetermined intensity acts upon the toner position opposite the jetting electrode on the toner carrying roller or to the toner in the vicinity thereof. Under the effect of this electric field, the electrostatic force applied to the toner exceeds the adhesion force between the toner and the toner carrying roller, toner aggregates are selectively jetted out from the toner carrying roller in the form of dots and introduced into the holes. The toner is then pulled by an electric field formed between the jetting electrode and the counter electrode that has a higher electric potential than the jetting electrode, and the toner continues flying through the holes, adheres to the surface of the recording paper, and forms a dot image.

In such as a direct image-recording device, the toner supply gap, which is a clearance between the toner carrying roller and the FPC, has to be set and maintained with high accuracy in order to obtain a high-quality image with good dot image density and resolution. For this reason, in such a conventional direct image-recording apparatus, positioning members that abut against the hole forming member where a plurality of holes have been formed and position the hole forming member with respect to the toner carrying roller have been provided at both axial ends of the toner carrying roller. By positioning the toner carrying roller with respect to the hole forming member with these positioning members, it is possible to set the toner gap, which is a clearance between the toner carrying roller and the hole forming member, to a predetermined distance.

However, in the direct image-recording device of such a configuration, the hole forming member comes into contact with the positioning members only in very small zones at both axial ends of the toner carrying roller and the position of the hole forming member is set in the so-called two-end supported state. As a result, deflection or distortion is easily caused by own weight of the hole forming member in the vicinity of the central portion thereof in the axial direction of the toner carrying roller. In particular, where the hole forming member is fabricated from a flexible material such as a flexible printed substrate, the deflection or distortion of the hole forming member in the vicinity of the central portion thereof in the axial direction of the toner carrying roller becomes significant. The resultant problem is that where such a deflection or distortion occurs in the hole forming member, a spread occurs in the toner supply gap in the axial direction of the toner support roller and the predetermined toner supply gap cannot be maintained over the axial direction of the toner carrying roller.

SUMMARY OF THE INVENTION

The present invention has been created in view of the above-described problem, and it is an object of the present invention to provide a direct image-recording device in which the predetermined gap between the agent carrier and the hole forming member can be set and maintained.

In an aspect of the present invention, a direct image-recording device comprises a housing that accommodates an image forming agent; an agent carrier that is rotatably supported by the housing, faces outside of the housing from an opening formed in the housing, and carries the image agent accommodated inside the housing; a sheet-like hole forming member having a plurality of holes formed therein and installed so as to face the agent carrier at a predetermined distance therefrom; a plurality of electrodes by which the image forming agent flies provided at the hole forming member correspondingly to each of the plurality of holes and form an electric field to cause selectively the image forming agent to fly from the agent carrier toward the holes; and a positioning member that is provided at the housing so as to cover the agent carrier that forms, on the basis of image information, an image by causing the image forming agent that is caused to fly selectively from the agent carrier to adhere, via the holes, to a recording member due to formation of the electric field, by which the image forming agent flies, the positioning member being configured to hold the hole forming member along an axial direction of the agent carrier by a side wall of the positioning member that has open portions formed in locations at least opposing the plurality of holes formed in the hole forming member, and configured to position the hole forming member relative to the agent carrier so that the relative positions of the agent carrier and the hole forming member are in a predetermined positional relationship.

In another aspect of the present invention, an image forming apparatus has a direct image-recording device. The direct image-recording device comprises a housing that accommodates an image forming agent; an agent carrier that is rotatably supported by the housing, faces outside of the housing from an opening formed in the housing, and carries the image agent accommodated inside the housing; a sheet-like hole forming member having a plurality of holes formed therein and installed so as to face the agent carrier at a predetermined distance therefrom; a plurality of electrodes by which the image forming agent flies provided at the hole forming member correspondingly to each of the plurality of holes and form an electric field to cause selectively the image forming agent to fly from the agent carrier toward the holes; and a positioning member that is provided at the housing so as to cover the agent carrier that forms, on the basis of image information, an image by causing the image forming agent that is caused to fly selectively from the agent carrier to adhere, via the holes, to a recording member due to formation of the electric field, by which the image forming agent flies, the positioning member being configured to hold the hole forming member along an axial direction of the agent carrier by a side wall of the positioning member that has open portions formed in locations at least opposing the plurality of holes formed in the hole forming member, and configured to position the hole forming member relative to the agent carrier so that the relative positions of the agent carrier and the hole forming member are in a predetermined positional relationship.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Prior to explaining the present invention, the prior art and problems associated therewith will be explained in greater detail with reference to the appended drawings.

Figure 1:
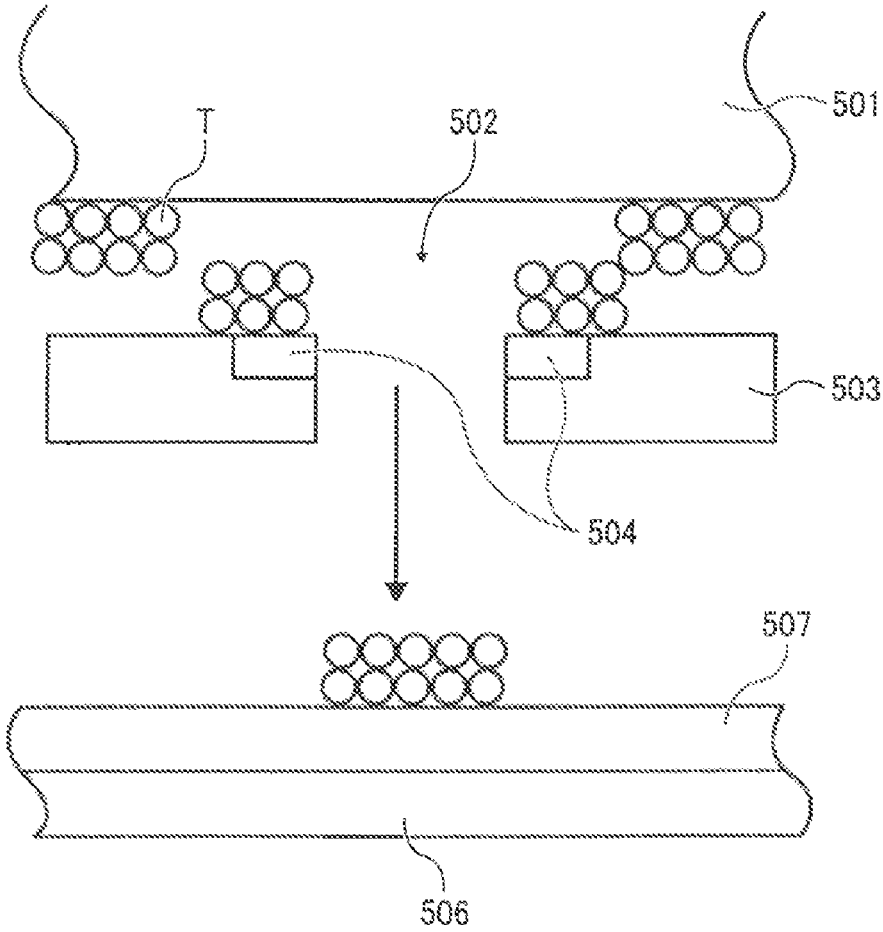
FIG. 1 PRIOR ART
FIG. 1 is a schematic drawing illustrating the basic configuration of the conventional direct image-recording device.

FIG. 1 shows an example of a principal configuration of the conventional direct image-recording device. In FIG. 1, a toner carrying roller 501 is disposed so that the axial line thereof extends in the left-right direction in the figure and carries on the surface thereof a charged toner T, while being rotationally driven by a drive means (not shown in the figure). A flexible printed substrate (hereinafter referred to as FPC) 503 serving as a hole forming member in which a plurality of holes 502 are formed is installed below the toner carrying roller 501. The FPC 503 is provided with a plurality of ring-shaped jetting electrodes 504 that are formed so as to surround the holes 502 on the surface facing the toner carrying roller 501.

A counter electrode 506 that faces the toner carrying roller 501, with the flexible printed substrate being interposed therebetween, and a recording paper 507 that is conveyed by a conveying means on the counter electrode 506 are installed below the FPC 503. In FIG. 1, only one hole 502 and one jetting electrode 504 are shown for the sake of convenience, but actually a plurality of combinations thereof are formed at the FPC 503. More specifically, at the FPC 503 for 600 dpi, a total of 4960 of such combinations of the hole and jetting electrode are formed.

As described above, the toner carrying roller 501 is, for example, in a grounded state and carries on the surface a toner T charged to a negative polarity. Where a jetting voltage of a positive polarity is applied to the jetting electrode 504, an electric field of a predetermined intensity acts upon the toner T in a position opposite the jetting electrode 504 on the toner carrying roller 501 or to the toner T in the vicinity thereof. Under the effect of this electric field, the electrostatic force applied to the toner T exceeds the adhesion force between the toner T and the toner carrying roller 501 and the aggregates of the toner T are selectively jetted out from the toner carrying roller 501 in the form of dots and introduced into the hole 502. The toner is then pulled by an electric field formed between the jetting electrode 504 and the counter electrode 506 that has a higher electric potential than the jetting electrode, and the toner continues flying through the hole 502, adheres to the surface of the recording paper 507, and forms a dot image.

ON/OFF switching of the jetting voltage applied to the jetting electrodes 504 is individually controlled by a special IC. Generally, the chip surface area of an IC has to be increased and the voltage resistance rises and a certain installation space is required for the circuit. For this reason, the IC is attached to the mounting substrate (not shown in the figure) that is integrally connected to the FPC 503, and the mounting substrate is disposed in a location slightly withdrawn from the FPC 503.

However, such a conventional direct image-recording apparatus has the above-described unresolved problems.

Embodiment 1

Embodiment 1 of the present invention will be described below. First, a direct image-recording method suitable for the present invention will be explained.

Figure 2:
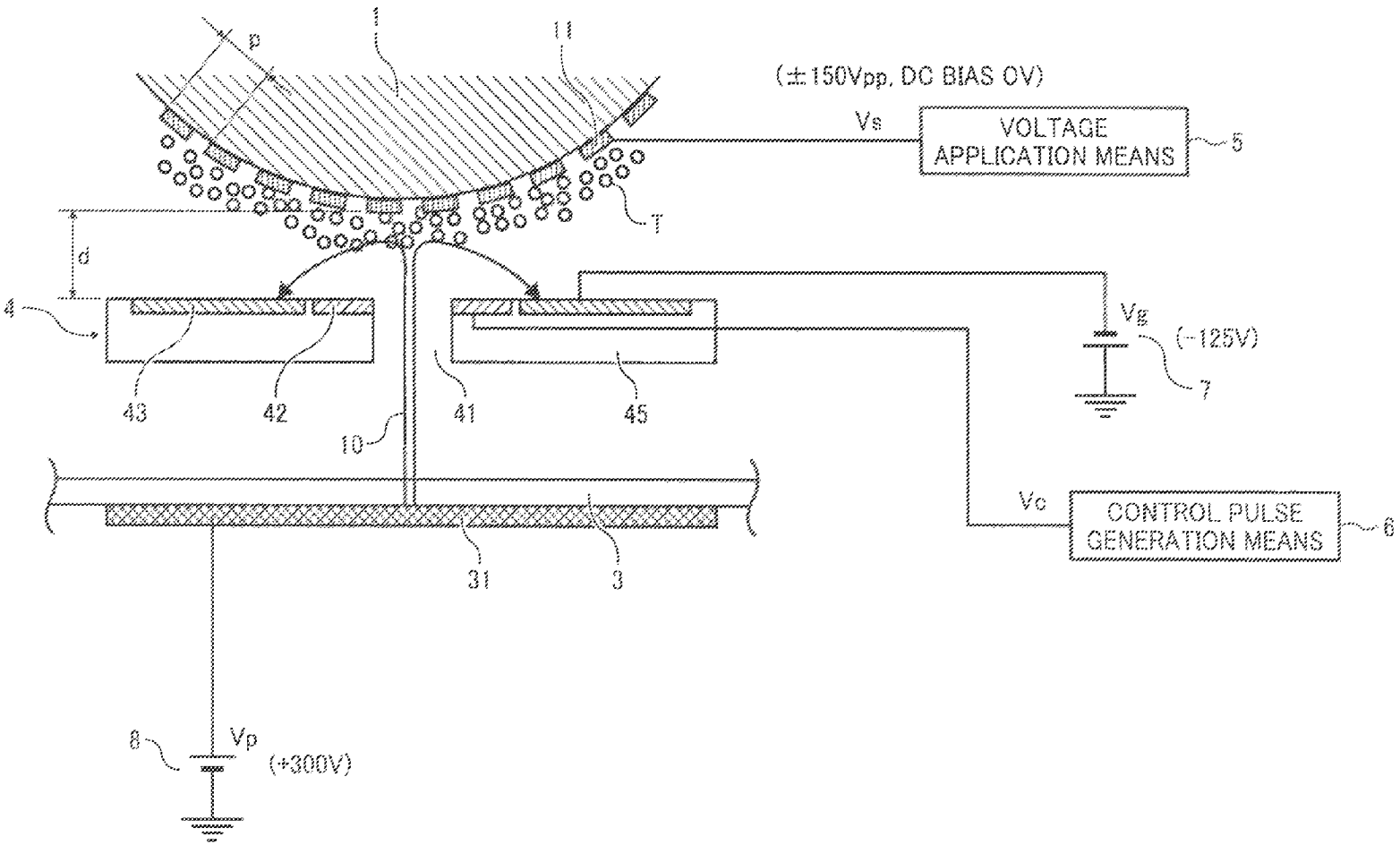
FIG. 2 illustrates the configuration of the direct image-recording device according to Embodiment 1 of the present invention.

As shown in FIG. 2, in the present embodiment, there are provided a roller-type toner carrier 1 that jets out the toner T and carries the toner in a cloud state, a recording medium 3 onto which the toner T is caused to adhere, and a toner control means 4 having a plurality of toner passage holes 41 and disposed between the toner carrier 1 and the recording medium 3.

The toner carrier 1 has a plurality of electrodes 11 that are provided with a predetermined pitch and formed along a direction (here, axial direction) perpendicular to the direction in which the toner T is carried with a predetermined spacing in the direction (here, circumferential direction) in which the toner T is carried on the surface of the toner carrier. A pulse voltage (ground pulse) that changes with time and has an average electric potential Vs is applied from a voltage application means power source 5 to the electrodes 11 of the toner carrier 1. As a result, a means for forming a cloud of the toner T is constituted.

For example, a pulse voltage with a frequency of 0.5 kHz to 7 kHz is applied, and because the electrodes 11 are provided with a fine pitch, a strong electric field is formed between the electrodes 11. Therefore, the toner T is jetted out with high intensity from the surface of the electrodes 11 that are at a repulsion potential with respect to the charge polarity of the toner T, the toner T that has been jetted out is pulled to the electrode 11 having applied thereto an electric potential of an attraction polarity, the jetting in the up-down direction is repeated correspondingly to the pulse frequency by switching the pulses, and the toner T assumes a cloud state. In a region with a high pulse frequency a pulse can be switched while the toner T that has been jetted out to a large height still flies and the toner can be again jetted upward before returning to the surface of the electrode 11.

The toner control means 4 is provided with a plurality of toner passage holes (openings) 41 through which the toner T can pass, ring-shaped control electrodes 42 are provided around the toner passage holes 41 on the surface of the toner control means 4 at the toner supply side (surface at the toner carrier 1 side), and a common electrode 43 that is common to a plurality of the toner passage holes 41 is provided on the outside of the control electrodes 42 with respect to the toner passage holes 41, with the insulating region being interposed therebetween.

Figure 3:
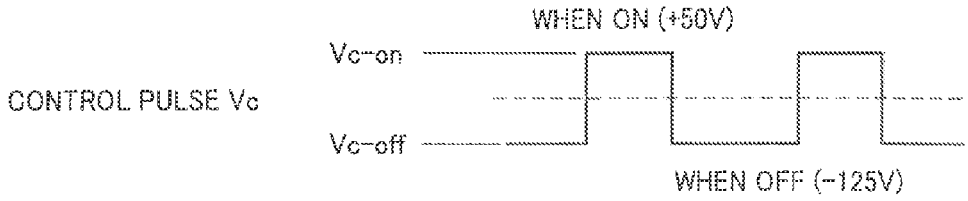
FIG. 3 illustrates an example of a control pulse applied to a control electrode of the direct image-recording device according to Embodiment 1.

A control voltage Vc, for example, such as shown in FIG. 3, is supplied from a control pulse generating means 6 to the control electrodes 42 of the toner control means 4. In this case, when the toner T is to assume a state (ON state) in which it can pass through the toner passage hole 41, a voltage Vc-on is applied to the control electrode 42, and when the toner T is to assume a state (OFF state) in which it cannot pass through the toner passage hole, a voltage Vc-off is applied to the control electrode 42. Further, a voltage Vg is applied from a regular power source means 7 to the common electrode 43. The control electrode 42 of the toner control means 4 can operate only around the toner passage hole 41, but this electrode may be also provided at the inner wall surface of the toner passage hole 41 or both at the inner wall surface of the toner passage hole 41 and around the hole at the toner carrier 1 side.

A back surface electrode 31 serving as an electrode means that acts as a bias voltage application means for applying a bias voltage for causing the toner T that has passed the toner control means 4 to adhere to the recording medium 3 is disposed at the rear surface of the recording medium 3 at the recording medium 3 side, and a bias voltage Vp from a bias power source means 8 is applied to cause the toner T that has passed through the toner control means 4 to adhere to the recording medium 3. The recording medium 3 may be an intermediate transfer recording medium that serves to form an image temporarily thereupon and then transfer the image onto the paper, or recording paper. The bias voltage Vp can be applied to the recording medium 3, for example, by a configuration in which a rear surface electrode 31 is disposed on the rear surface side (surface on the side opposite that facing the toner carrier 1) and passing the recording medium 3 over the upper surface of the rear surface electrode 31, a configuration in which an intermediate transfer recording medium is provided and an electrode is embedded inside thereof (configuration in which an electrode at the recording medium means side serves as an inner electrode), or a configuration in which the rear surface electrode 31 is disposed at the rear surface of the intermediate transfer recording medium.

Here, the toner carrier 1 and the toner control means 4 are disposed as a means for forming a cloud of the toner located on the surface of the toner carrier 1 at a relationship ($p<d$) at which a distance d between the surface of the toner carrier 1 and the surface of the toner control means 4 at the toner carrier 1 side (means the surface at the toner carrier 1 side), that is, the toner supply gap becomes larger than a pitch p between two-phase electrodes that apply a voltage of a relationship such that the direction in which the toner T is attracted and the direction in which the toner is repulsed are repeated alternately between the adjacent electrodes 11 when the voltage Vs is applied to the plurality of electrodes 11 provided at the surface of the toner carrier 1 (or a pitch between n-phase electrodes that apply n-phase voltage to every n electrodes 11).

This is because when a relationship $p>d$ is satisfied, the jetting electric field that is formed at the surface of the electrodes 11 of the toner carrier 1 interferes with the ON/OFF electric field at the surface of the toner control means 4 at the toner carrier 1 side and the below-described loop electric field of the toner control means 4 is disturbed. As a result, the toner can easily adhere to the surface of the control electrodes 42. When the condition $p_{<}d$ is satisfied, the toner can be reliably prevented from adhering to the control electrode 42, the density does not change even when continuous dots are printed, and good image can be obtained.

Figure 4A:
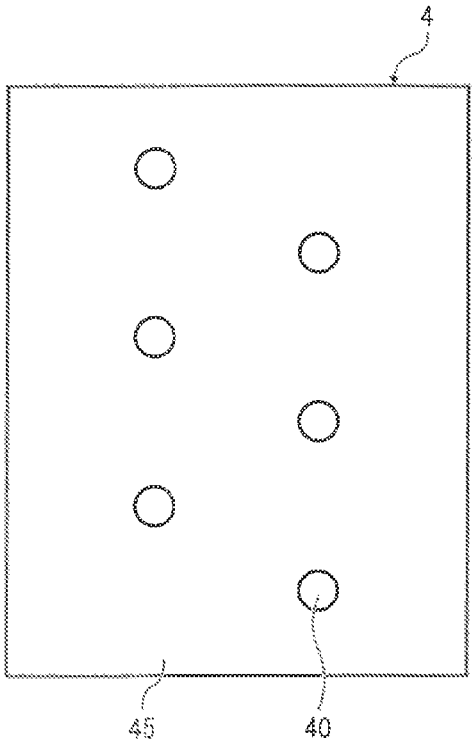
FIG. 4A illustrates the configuration of the toner control means of the direct image-recording device according to Embodiment 1 on the printing surface side.
Figure 4B:
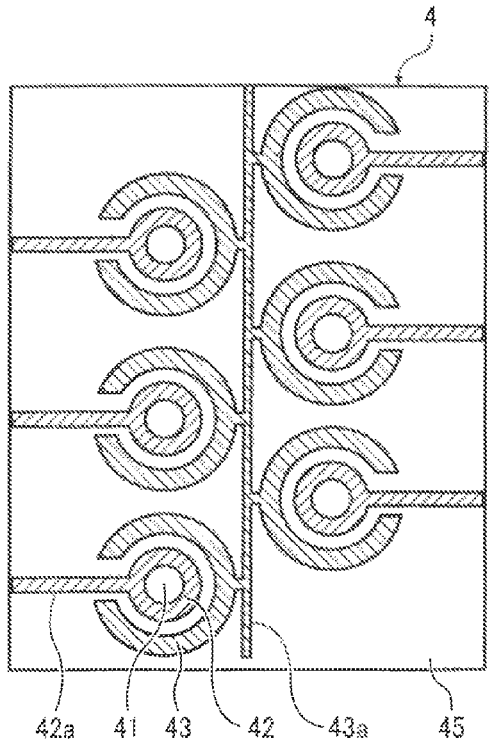
FIG. 4B illustrates the configuration of the toner control means of the direct image-recording device according to Embodiment 1 on the toner supply surface side.

An example of specific configuration of the toner control means 4 will be explained hereinbelow with reference to FIG. 4A and FIG. 4B. FIG. 4A shows the toner control means 4 at the printing surface side, and FIG. 4B shows the toner control means 4 at the toner supply side.

In this example, ring-shaped control electrodes 42 with a width of 10 μm to 100 μm are provided, so as to surround the toner passage holes 41, at the surface of an insulating substrate (base material) 45 at the toner supply side (toner carrier 1 side), and a common electrode 43 that applies the common bias voltage Vg to the plurality of the toner passage holes 41 is provided at the same surface with the control electrodes 42 at a distance of 20 μm to 50 μm from the control electrodes 42, that is, so that an insulating region formed by the insulating substrate 45 is interposed between the common electrode and the control electrodes.

The diameter ϕ of the toner passage hole 41 is determined by the size of the dot to be formed and is generally 30 μm to 150 μm. A lead pattern 42*a* for connecting to a driver circuit (drive circuit) for ON, OFF controlling the passage of toner T is connected to each control electrode 42 individually. The common electrode 43 is connected to a common lead pattern 43*a*. Further, the toner passage holes 41 are opened at the printing surface side of the insulating substrate 45 (surface at the recording medium 3 side).

By configuring the common electrode 43 of the toner control means 4 so that it surrounds in a ring-like fashion the outside of the control electrode 42, with the insulating region being interposed therebetween, it is possible to form an electric force that is formed between the bias potential at the recording medium 3 side and the common electrode 43 outside the control electrode 42 as an independent electric force line for each toner passage hole. Therefore, mutual interference (effect produced by the state of another toner passage hole 41) in a multi-drive mode (drive in which the toner is jetted out from a plurality of toner passage holes) can be prevented.

Further, because the control electrodes 42 and common electrode 43 of the toner control means 4 are formed at the same surface, they can be simultaneously formed in the same manufacturing process and the electrodes can be produced with high accuracy and at a low cost.

Figure 5A:
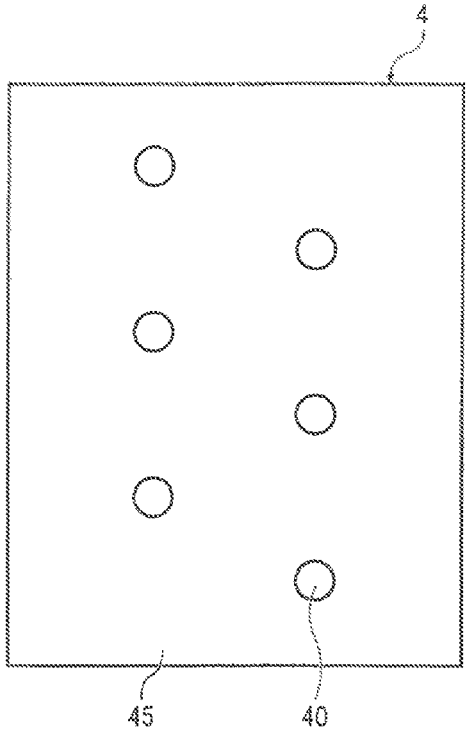
FIG. 5A illustrates the configuration of the toner control means of the direct image-recording device according to Embodiment 1 on the printing surface side.
Figure 5B:
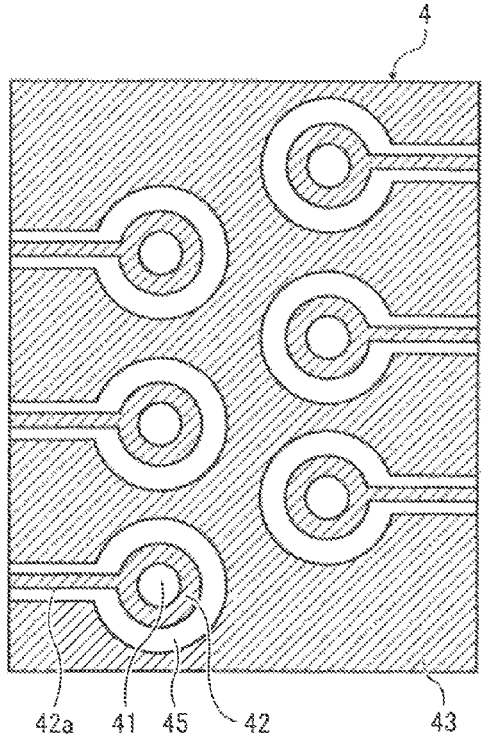
FIG. 5B illustrates the configuration of the toner control means of the direct image-recording device according to Embodiment 1 on the toner supply surface side.

Another example of the specific configuration of the toner control means 4 will be explained below with reference to FIG. 5A and FIG. 5B. FIG. 5A shows the toner control means 4 at the printing surface side, and FIG. 5B shows the toner control means 4 at the toner supply side.

In this example, the ring-shaped control electrodes 42 with a width of 10 μm to 100 μm are provided, so as to surround the toner passage holes 41, at the surface of the insulating substrate (base material) 45 at the toner supply side (toner carrier 1 side), and a common electrode 43 that applies the common bias voltage Vg to the plurality of the toner passage holes 41 is provided at a distance (insulating region) of 20 μm to 50 μm from the control electrodes 42 in a solid configuration so as to cover the entire open space.

With such a solid configuration in which the common electrode 43 of the toner control means 4 is provided outside the control electrodes 42, with the insulating region being interposed therebetween, that is, with the configuration in which the common electrode 43 is formed over the entire external region of the control electrode 42, the electric field of the bias potential at the recording medium 3 side can be shielded, the adhesion of the toner to the control electrode 42 can be reduced, and the toner can be used with higher efficiency.

In a specific method for manufacturing the toner control means 4, a resin film, for example, a polyimide, PET, PEN, or PES, with a thickness of 30 μm to 100 μm is used from the standpoint of cost and manufacturing process as an insulating member serving as the insulating substrate 45. First, an Al vapor-deposited film with a thickness of 0.2 μm to 1 μm is formed on the film surface. Then, in a photolithographic process, a photoresist is coated with a spinner and then prebaking and mask exposure are performed and development is conducted. After thermal curing of the photoresist has advanced, the Al patterning is conducted with an Al etching solution. In case where an electrode pattern is also required for the rear surface of the film, the operations can be conducted in the same manner as described above, or a pattern used as a mask for hole processing may be formed at the rear surface. Where mechanical processing by pressing after pattern formation, excimer laser processing using a pattern formed at the rear surface, or dry etching processing such as sputter etching is used to form through holes serving as the toner passage holes 41, displacement-free highly accurate hole processing can be performed.

In the image forming apparatus that realizes the direct recording method of the above-described configuration, where a pulse voltage of the average potential Vs is applied to the electrode 11 of the toner carrier 1, the toner T is jetted out and forms a cloud on the toner carrier 1, and the toner T is conveyed by conveying induced by rotation or travelling-wave electric field of the toner carrier 1. The printing bias voltage Vp is applied to the rear surface electrode 31 at the recording medium 3 side.

In this state, the voltage Vg is applied to the common electrode 43 of the toner control means 4, and when a state is to be assumed (ON state) in which the toner T can pass through the toner passage hole 41, the voltage Vc-on of the ON mode shown in FIG. 3 is applied to the control electrode 42, whereas when a state is to be assumed (OFF state) in which the toner T cannot pass through the toner passage hole 41, the voltage Vc-off of the OFF mode shown in FIG. 3 is applied to the control electrode.

In this case, where the voltage applied to these electrodes 11, 31, 42, and 43 is set to certain values, when the toner control means 4 is to be in a state in which the toner T of the toner carrier 1 can pass through toward the recording medium 3, an electric force line 10 is formed that bypasses the control electrode 42 that controls the passage of the toner between the recording medium 3 side and the common electrode 43 of the toner control means 4.

As a result, the toner that has generated a cloud on the toner carrier 1 is driven by an electric field created by the electric force line 10, passes through the toner passage hole 41 of the toner control means 4, and lands on the recording medium 3. Therefore, by ON/OFF controlling (opening-closing control) each toner passage hole 41 of the toner control means 4 correspondingly to the image, it is possible to form a toner image directly on the recording medium 3. Because the loop-shaped electric force line 10 is formed so as to bypass the control electrode 42 that controls the passage of the toner between the recording medium 3 side and the common electrode 43 of the toner control means 4, the adhesion of the toner to the periphery of the control electrode 42 and toner passage hole 41 is reduced. Further, because the toner cloud is generated, the toner can be used with higher efficiency.

Example 1

Example 1 of a printer unit 12 in accordance with the present invention that uses the toner carrier 1 and the toner control means 4 of the above-described direct image-recording method will be explained below.

Figure 6:
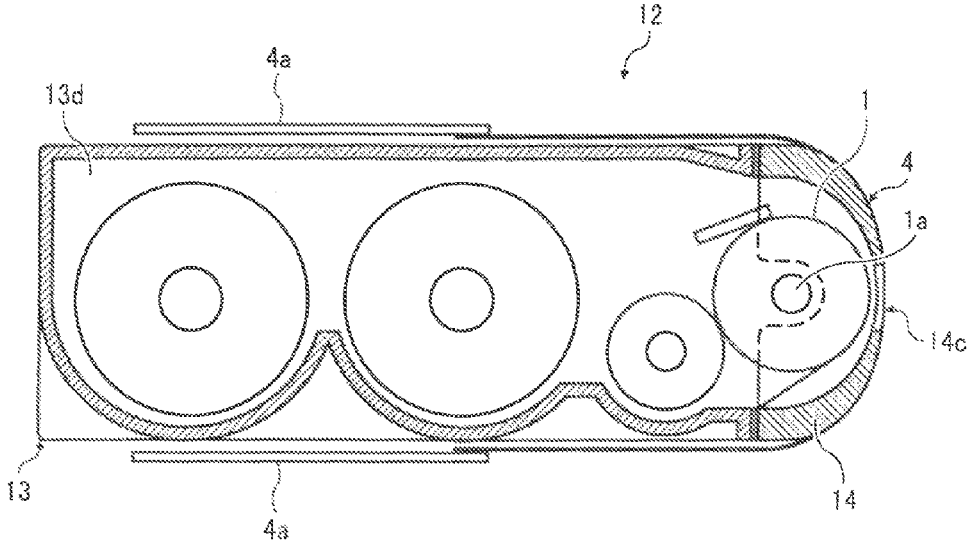
FIG. 6 shows a schematic configuration of a printer unit according to Embodiment 1 as viewed from the side surface.

FIG. 6 shows a schematic configuration of the printed unit 12 as viewed from the side surface. The printer unit 12 is mainly composed of the following three components: a development unit 13 that supports the toner carrier 1, the toner control means 4, and the holder 14 that attaches the toner control means 4. These three components are integrated in a freely detachable manner so that the printer unit 12 can be easily assembled and disassembled.

In the present example, a holder 14 that determines the relative position of the toner conveying body 1 and the toner control means 4 is introduced between the development unit 13 and the toner control means 4 in order to form and set the predetermined toner supply gap, which is the clearance between the toner conveying body 1 and the toner control means 4. A method can be also considered by which the toner control means 4 is attached directly to a development unit case 13*d* of the development unit, for example, while bending so as to cover the toner carrier 1, without using the holder 14, but this method causes the above-described problems, and because of a low rigidity of the toner control means 4, the toner supply gap is difficult to set and maintain with good accuracy over the entire region of the toner control means 4. Further, vibrations, for example, from the drive system of the image forming apparatus body can cause a resonance and gap fluctuations can occur. In order to resolve these problems, it is necessary to guide the toner control means 4 over the entire region in accurate positions from the desirable surface shape in the toner control means 4, and align the toner control means 4 with respect to the toner carrier 1 so as to obtain a predetermined toner supply gap between the toner carrier 1 and the toner control means 4.

Accordingly, in the present example, the holder 14 was provided as a guide member that performs guiding so as to obtain the desirable surface shape over an almost entire area of the toner control means 4, except the region of a large number of the toner passage holes 41 that have been opened in the toner control means 4. Where the holder 14 is used, almost the entire area of the toner control means 4, except the region of the toner passage holes 41, is held by the side wall of the holder 14. Therefore, drawbacks caused by the aforementioned low rigidity of the toner contrail means 4 can be overcome, deflection or distortion such as a spread in the toner supply gap in the axial direction of the toner carrier in the vicinity of the central portion of the toner control means 4 in the axial direction of the toner carrier can be eliminated, and the desirable surface shape of the toner control means 4 can be formed and set in a correction position with respect to the toner carrier 1.

Structural elements of the printed unit 12 will be described below in greater detail.

Figure 7:
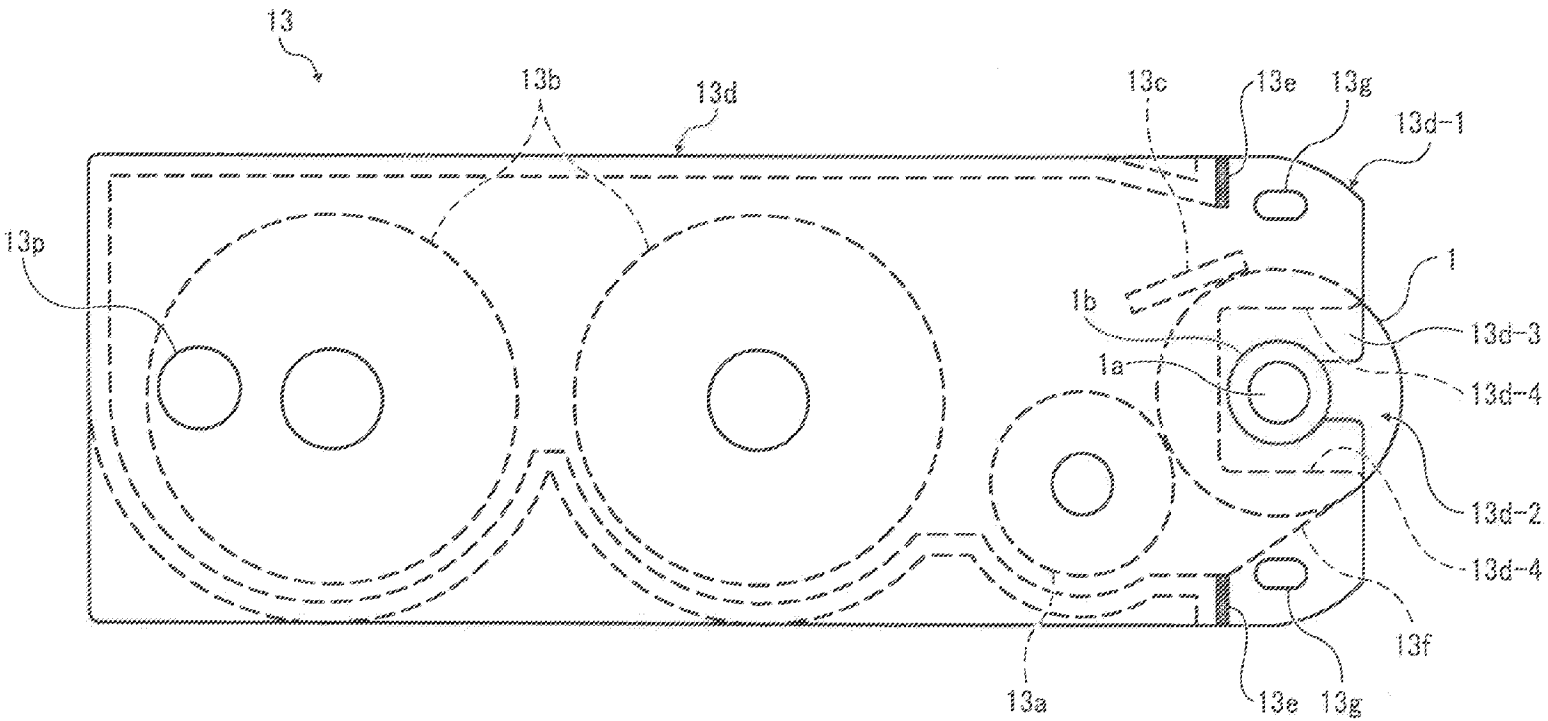
FIG. 7 shows a configuration of a development unit of the printer unit as viewed from the side surface.

FIG. 7 is a side view of the development unit 13 in the printer unit 12. The development unit 13 of the present example uses a two-component developer composed of a magnetic carrier and a nonmagnetic carrier. The development unit 13 may also have a configuration using a one-component developer that is composed of a nonmagnetic toner.

The development unit 13 is constituted by a development unit case 13*d* that accommodates the developer, the roller-shaped toner carrier 1 that carries the toner, a magnetic roller 13*a* that supplies the developer located in and the development unit case 13*d* to the toner carrier 1, two stirring screws 13*b* that stir the developer inside the development unit case 13*d*, and a blade 13*c* that produces a thin layer of the toner on the toner carrier 1. The toner carrier 1, magnetic roller 13*a*, stirring screws 13*b*, and blade 13*c* are accommodated in the development unit case 13*d*.

The toner carrier 1 is rotatably supported via a shaft 1*a* of the toner carrier 1 and a bearing 1*b* fitted on the shaft 1*a* by a side plate 13*d*-1 of the development unit case 13*d* and a side plate (not shown in the figure) that is located at the farther side of the paper sheet in FIG. 7 opposite the other side plate in the axial direction of the toner carrier so as to sandwich the toner carrier 1 between the side plates 13*d*-1. The toner carrier is coupled to a motor (not shown in the figure) and can be rotary driven thereby. The two-component developer is conveyed by the magnetic roller 13*a* enclosing a permanent magnet to a position facing the toner carrier 1. Here, a bias is applied to a portion of the toner and under the effect of the bias potential, the toner moves from the magnetic roller 13*a* to the toner carrier 1. The toner that has been transferred to the toner carrier 1 is converted by the above-described method into a cloud state, a thin layer thereof is produced by the blade 13*c* when the toner carrier 1 is rotated, and the transfer moves to the position facing the toner control means 4. By the above-described method, the toner converted into a cloud state on the toner carrier 1 is driven by the electric field, caused to pass through the toner passage holes 41 of the toner control means 4, and lands on a recording medium means (not shown in the figure) to print an image.

The toner that has not been used for printing and remains on the toner carrier 1 is returned again to the magnetic roller 13*a* by the rotation of the toner carrier 1. Because the adhesion force of the toner in a cloud state to the surface of the toner carrier 1 is very weak, the toner that has not been printed and is located on the toner carrier 1 that has returned to a position opposite the magnetic roller 13*a* is easily scraped off and evened out by the crest of the two-component developer that traces the rotation of the magnetic roller 13*a*. By repeating this operation, it is possible to carry an almost constant amount of toner in a cloud state at all times on the toner carrier 1.

Further, the development unit case 13*d* of the development unit 13 has a configuration in which the side (right side surface in the figure) thereof where the toner carrier 1 is supported is open and the toner carrier 1 is exposed to the outside of the development unit case 13*d*. This is done with consideration for assembling ability and easiness of replacement of the toner carrier 1 and makes it possible to attach the toner carrier to the development unit 13 and detach therefrom in a simple manner. The attachment of the toner carrier 1 to the development unit 13 and detachment therefrom may be conducted by attaching the bearing 1*b* mounted on the shaft of the toner carrier 1 to the development unit case 13*d* and detaching therefrom, or by inserting the shaft 1*a* of the toner carrier 1 through a notch 13*d*-2 provided in a portion of the side plate 13*d*-1 that supports the toner carrier 1 or removing the shaft through the notch.

A groove 13*d*-3 (dot-like portion in the figure) that has a U-like shape such as to surround the bearing 1*b* is formed in the inner side surface of the portion of the side plate 13*d*-1 that supports the toner carrier 1, and the upper and lower end surface portions 13*d*-4 of the groove 13*d*-3 are in a mating relationship with a convex side surface portion of the below-described holder 14.

The holder 14 that is attached so as to cover the toner carrier 1 plays a role of a lid for the open side surface (right side surface) where the toner carrier 1 is supported and exposed. Therefore, the toner is prevented from falling out from the open side surface and scattering. Further, the development unit case 13*d* is provided with sealing members 13*e*, 13*f* for preventing the toner from leaking out from the gap between the development unit case 13*d* and the holder 14 when the holder 14 is attached to the development unit case 13*d*. An attachment orifice 13*g* is provided in the development unit case 13*d* for screwing the holder 14 to the development unit case 13*d*.

Figure 8B:
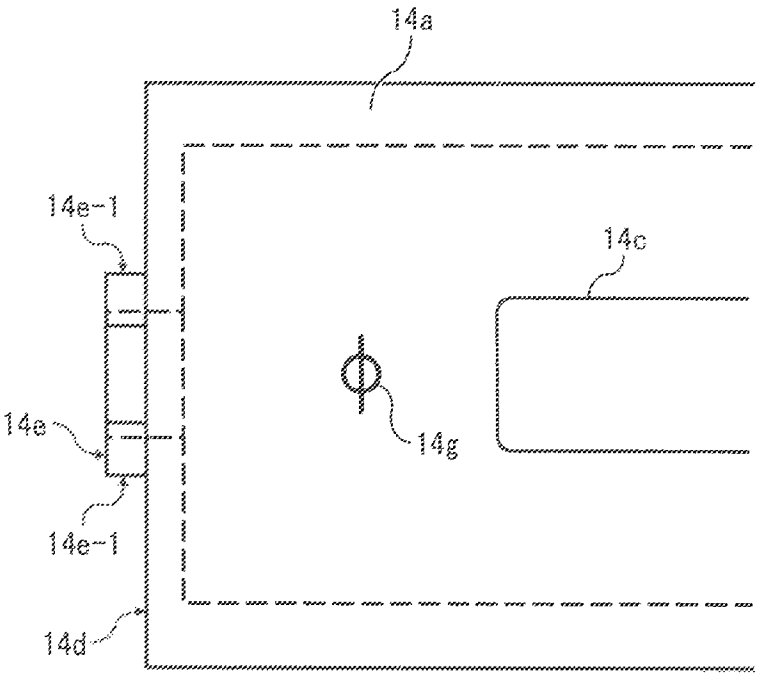
FIG. 8B shows a configuration of the holder as viewed from the front surface.
Figure 8A:
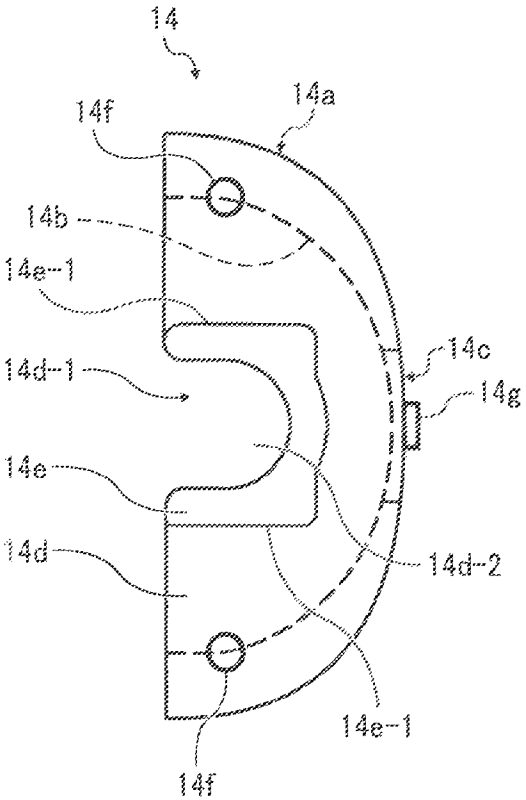
FIG. 8A shows a configuration of a holder of the printer unit as viewed from the side surface.

FIG. 8A is a side view of the holder 14. FIG. 8B shows part of the holder 14 when the holder 14 is viewed from the front surface. The holder 14 is so configured that when the holder 14 that holds the toner control means 4 at the side surface portion 14*a* is attached to the development unit 13, the toner control means 4 faces the toner carrier 1 and the predetermined toner supply gap between the toner carrier 1 and the toner control means 4 can be accurately formed and set.

The side surface portion 14*a* of the holder 14 is formed in a desired surface shape (curved shape) such that the toner control means 4 can be positioned with respect to the toner carrier 1 so that the predetermined toner supply gap is formed. Therefore, this side surface portion guides almost the entire toner control means 4 and is attached so that the toner control means 4 is in intimate contact with the side surface portion 14*a*.

A space inside the holder 14 that is formed in the side surface portion 14*b* of the holder 14 is large enough to accommodate the toner carrier 1. This space is provided to prevent the toner carrier 1 from being damaged by contact of the toner carrier 1 with the side surface portion 14*b* when the holder 14 is attached and detached and also to prevent the toner from being scattered by a gas flow generated when the toner carrier 1 is rotated.

An open portion 14*c* that passes through the side surface portion 14*a* and the side surface portion 14*b* is provided in a position where the toner carrier 1 of the holder 14 and the toner control means 4 held at the side surface portion 14*a* face each other. The open portion 14*c* is slightly larger than the region where the plurality of toner passage holes 41 of the toner control means 4 are formed, and the toner jetting is performed from the toner carrier 1 toward the toner control means 4 through the open portion 14*c*. The size of the opening of the open portion 14*c* is made slightly larger than the region where the plurality of toner passage holes 41 of the toner control means 4 for the following reason: in the zone where the open portion 14*c* is present, the toner control means 4 is in a state in which it is not held at the side surface portion 14*a* of the holder 14 and is not guided and therefore where the toner control means 4 is in the zone abutting against the open portion 14*c*, deflection or distortion can occur in the toner control means. Thus, in order to reduce the occurrence of such deflections or distortions in the toner control means 4 to a minimum, it is preferred that the opening of the open portion 14*c* be narrowed to a degree that does not hinder the toner flying function and the region where the toner control means 4 is not held by the side surface portion 14*a* of the holder 14 be narrowed as much as possible.

With the above-described configuration, the desired surface shape can be formed and the toner control means 4 can be set with respect to the toner carrier 1 in a correct position in which the predetermined toner supply gap between the toner carrier 1 and the toner control means 4 can be maintained.

Further, as shown in FIG. 8A, a U-shaped notch 14*d*-1 that will mate with the bearing 1*b* of the toner carrier 1 is provided in the side surface portion 14*d* at the front side in the figure, and when the holder 14 is attached to the development unit case 13*d*, the inner wall surface of the notch 14*d*-1 and the outer circumferential surface of the bearing 1*b* are brought into contact and the toner carrier 1 and the notch 14*d*-1 are mated together so that the central position of the bearing 1*b*, that is, the central position of the toner carrier 1, matches a central position 14*d*-2 of the notch 14*d*-1. By inserting the bearing 1*b* till it abuts against the inner wall surface of the U-shaped notch 14*d*-1, an accurate position of the holder 14 relative to the toner carrier 1 is determined (the position of the holder 14 in the up-down direction and left-right direction with respect to the toner carrier) is determined. As a result, it is possible to align the toner control means 4 that is held at the side surface portion 14*a* of the holder 14 with respect to the toner carrier 1.

However, where the bearing 1*b* is mated with the U-shaped notch 14*d*-1, the holder 14 can rotate about the bearing 1*b*. Therefore, it is necessary to position the holder 14 in the rotation direction of the toner carrying member, that is, to stop the rotation of the holder 14.

In the present example, the following means is used to position the holder 14 in the rotation direction of the toner carrier. Thus, as shown in FIG. 8B, a mating relationship is established for an up-down end surface portion 14*e*-1 of a convex portion 14*e* that is formed so as to protrude outward from the side surface portion 14*d* of the holder 14 and an end surface portion 13*d*-4 of a groove 13*d*-3 of the above-described development unit case 13*d*, and the positioning of the holder 14 in the rotation direction of the toner carrying member with respect to the development unit case 13*d* is conducted by inserting the convex portion 14*e* into the groove 13*d*-3.

Figure 9:
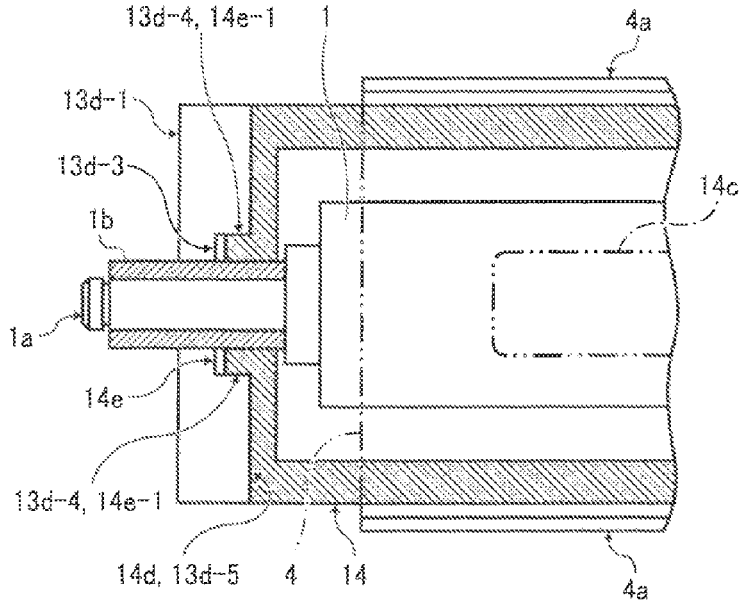
FIG. 9 is a cross-sectional view illustrating a configuration in the vicinity of a mating portion of the holder and the development unit in a case the printer unit is viewed from the front surface.

The holder 14 has a configuration that can be mounted inside the development unit 13. More specifically, as shown in FIG. 9, an inner side surface portion 13*d*-5 of the portion of the side plates 13*d*-1 at both sides of the development unit case 13*d* that support the toner carrier 1 and the side surface portion 14*d* of the holder 14 are brought into contact and mounted, while being in intimate contact with each other. As a result, the position of the holder 14 in the axial direction of the toner carrier with respect to the development unit 13 is determined.

As described above, the holder 14 is positioned with respect to the development unit 13 by using the bearing 1*b* of the toner carrier 1 as a reference. Further, a screw orifice 14*f* is opened in the side surface portion 14*d* of the holder 14, the screw orifice being formed in a location that will face an attachment orifice 13*g* formed in the development unit case 13*d* when the holder 14 is positioned and attached to the development unit 13. A screw is then inserted into the attachment orifice 13*g* and screw orifice 14*f*, and the holder 14 is tightened with the screw and fixed to the development unit case 13*d* of the development unit 13.

From a recent standpoint of environmental protection, it is an obligation of a manufacturer to reuse the image forming apparatus and components thereof. Consumable components such as process cartridges and printer units, primarily development units that are especially frequently replaced produce a significant effect on environment, and most manufacturers research and develop configurations, shapes, and business model of unit and components that can be easily reused. In other words, the printer 12 is described that has good assembling ability and disassembling ability that take reuse into account.

The toner control means 4 is attached to the holder 14, for example, by a method by which, as shown in FIG. 8B, a reference pin 14*g* that serves as a reference for positioning the toner control means 4 with respect to the side surface portion 14*a* is provided in the vicinity of both ends of the side surface portion 14*a* of the holder 14 in the axial direction of the toner carrier, positioning of the toner control means 4 with respect to the side surface portion 14*a* is conducted by mating a hole for mating with the reference pin 14*g* that is opened in the toner control means 4 with the reference pin 14*g* when the toner control means 4 is attached to the side surface portion 14*a*, and the toner control means 4 is attached to the side surface portion 14*a* with an adhesive material or pressure-sensitive adhesive material (including a two-side tape) after such positioning has been competed.

In the present example, as shown in FIG. 6, an electric mounting base 4*a* that drives and controls the toner control means 4 is integrally connected to the end portion of the toner control means 4. The electric mounting base 4*a* is attached and fixed to the side surface of the development unit case 13*d*. In a case where the toner control means 4 has to be replaced or reused, the toner control means 4 has to be easily attachable to and detachable from the holder 14. Therefore, in such a case, the following method is employed instead of pasting. Thus, the toner control means 4 is positioned with respect to the side surface portion 14*a* and then a tension is exerted on the toner control means 4 by pulling the electric mounting bases 4*a* at both ends of the toner control means 4 with springs or the like in the direction (to the left in FIG. 6) opposite the opening side surface of the development unit case 13*d* to which the holder 14 will be attached perpendicularly to the axial direction of the toner carrier, and the electric mounting base 4*a* is attached to the development unit case 13*d*, while bringing the toner control means 4 into intimate contact with the holder 14. However, in this case, the cost is raised and attachment space is increased by comparison with those of the case in which the toner control means 4 is attached to the side surface portion 14*a* with an adhesive material or a pressure-sensitive adhesive material.

In a case where deflection or distortion are still generated and the desired surface shape cannot be formed even when the toner control means 4 is attached to the holder 14, a reinforcing material such as a thin stainless steel sheet may be pasted to the toner control means 4 or holder 14, while paying full attention to possible electric failures (short circuit or current leak).

Figure 10:
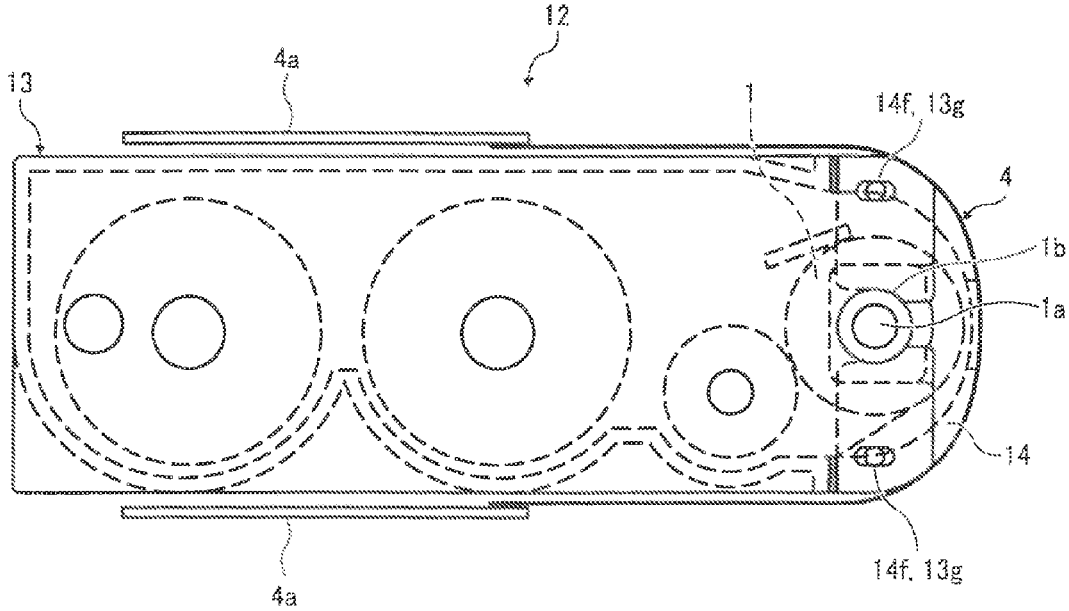
FIG. 10 is a side view of a configuration of the printer unit in which the holder and the toner control means are aligned and attached to the development unit, with the bearing of the toner carrier serving as a reference.

FIG. 10 is a side surface view of the printer unit 12 in which the holder 14 and the toner control means 4 are positioned and attached to the development unit 13 by using the bearing 1*b* of the toner carrier 1 as a reference. The screw for fixing the holder 14 to the development unit 13 is omitted.

Figure 11:
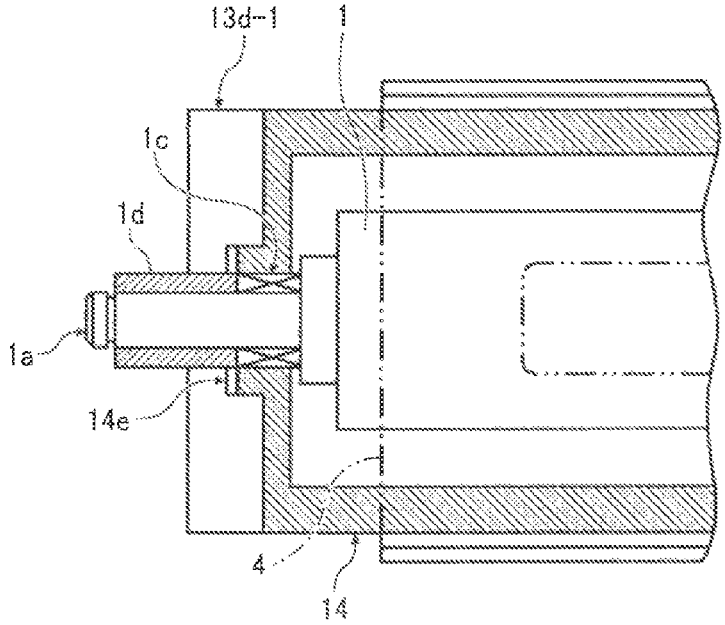
FIG. 11 and FIG. 12 are cross-sectional views illustrating a configuration in the vicinity of a mating portion of the holder and the development unit in a case the printer unit is viewed from the front surface.

FIG. 9 shows a cross section of the development unit 13 cut in the axial direction of the toner carrier in a position of the toner carrier 1 shown in FIG. 10 in a case where the printer unit 12 is viewed from the front. The configuration, mutual arrangement, and mating relationship of the toner carrier 1, development unit 13, and holder 14 explained in FIGS. 7, 8A, and 8B can be easier understood when referring to FIG. 9. In the configuration shown in FIG. 11, the bearing 1*b* that supports the toner carrier 1 and mates with the holder 14 in the development unit 13 as shown in FIG. 10 is divided into two bearings: a bearing 1*c* that mates with the holder 14 and a bearing 1*d* that supports the toner carrier 1 at the development unit 13. In other words, the bearing 1*c* that serves as a reference when positioning the holder 14 with high accuracy with respect to the toner carrier 1 is provided separately from the bearing 1*d* that rotatably supports the toner carrier 1 with respect to the development unit 13.

The bearings used in development units are usually sliding bearings made from a resin to reduce cost and ensure electric insulation, and a sliding bearing is also used for the toner carrier 1 itself because the rotation accuracy is not affected. In the bearing 1*b* shown in FIG. 9, the bearing 1*b* that is a sliding bearing supported at the development unit 13 is extended to be also used for mating with the holder 14, but in the present example, the position of the holder 14, that is, the position of the toner control means 4 is determined with reference to the bearing. Therefore, in a case where the toner supply gap is of several tens of microns, problems are associated with the bearing accuracy. Accordingly, in the configuration shown in FIG. 11, the bearing 1*c* that mates with the holder 14 is provided is a bearing with good accuracy that is independent from the bearing 1*d*, for example, a highly accurate bearing such as a rolling ball bearing.

Figure 12:
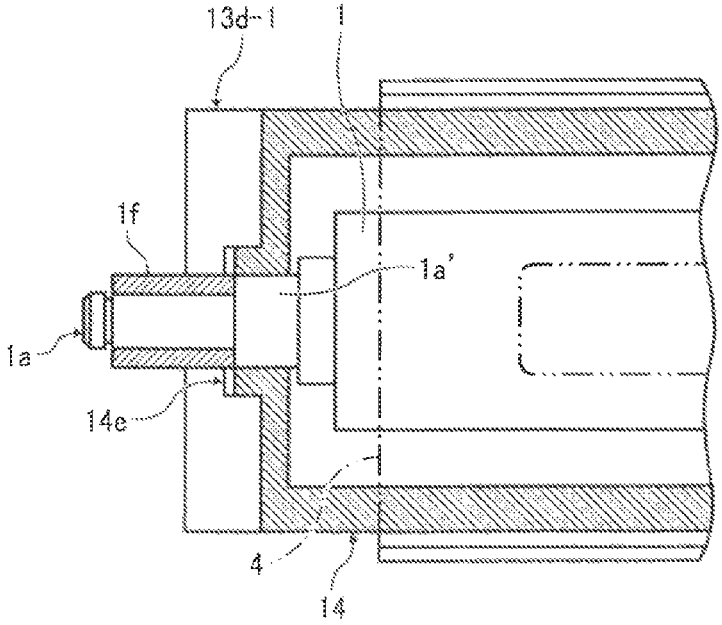

FIG. 12 illustrates another mode of a toner carrier bearing in which the elongated bearing 1*b* provided at the shaft la of the toner carrier 1 in FIG. 9 is configured as a short bearing if that has a length sufficient to support the toner carrier 1 at the development unit 13, and the holder 14 mates with a large-diameter portion 1*a*' obtained by local increase in diameter of the shaft 1*a* of the toner carrier 1. In this case, at least the mating portion of the holder 14 that mates with the large-diameter portion 1*a*' of the shaft 1*a* of the toner carrier 1 has to be made from an insulating resin with good sliding ability. Thus, in the configuration shown in FIG. 12, the holder 14 is positioned with respect to the toner carrier 1 with reference to the large-diameter portion 1*a*' of the shaft 1*a* of the toner carrier 1 and then the toner control means 4 is positioned with respect to the toner carrier 1.

Figure 13A:
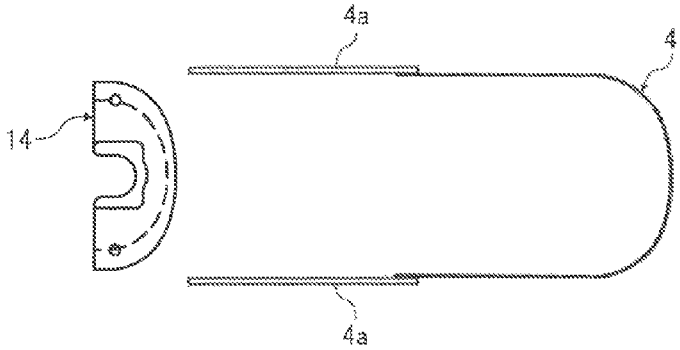
FIG. 13A and FIG. 14A illustrate the assembling process 1 of the printer unit.
Figure 13B:
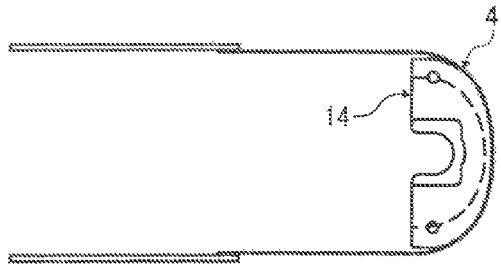
FIG. 13B and FIG. 14B illustrate the assembling process 2 of the printer unit.
Figure 13C:
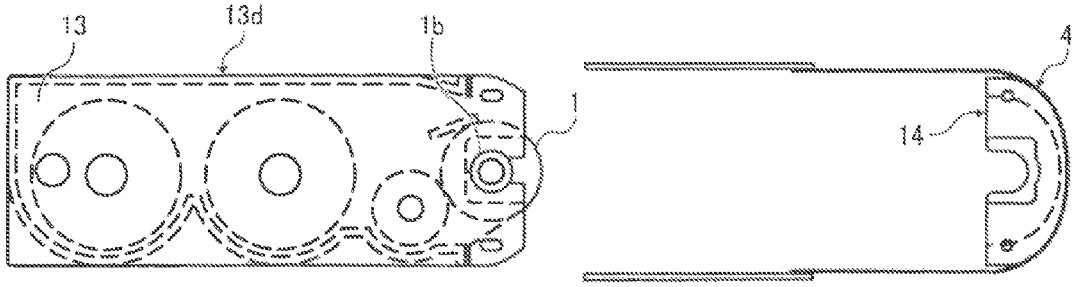
FIG. 13C and FIG. 14C illustrate the assembling process 3 of the printer unit.
Figure 13D:
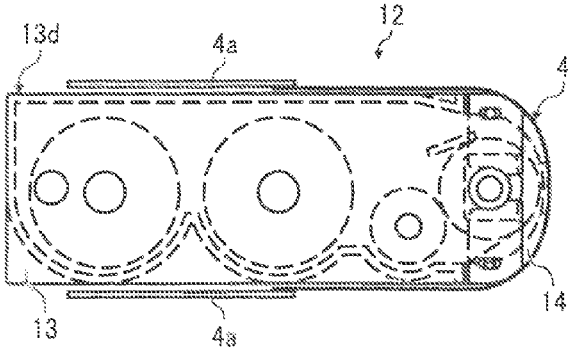
FIG. 13D and FIG. 14D illustrate the assembling process 4 of the printer unit.

FIGS. 13A, 13B, 13C, and 13D illustrate successively the assembling procedure of the printer unit 12 that results in the fabrication of the printer unit 12 in which the holder 14 holding the toner control means 4 is attached to the development unit 13 such as shown in FIG. 10. FIG. 13D is identical to FIG. 10.

First, as shown in FIG. 13A, the holder 14 and the toner control means 4 connected to the electric mounting base 4*a* are prepared. In FIG. 13A, the toner control means 4 is shown in a final curved shape for the sake of convenience, but as a single unit it is actually in a flat state, including the electric mounting base 4*a*. Then, as shown in FIG. 13B, the toner control means 4 is pasted to the holder 14, while being positioned with the reference pin 14*g* shown in FIG. 8B. Then, as shown in FIG. 13C, the toner control means 4 together with the holder 14 are mounted on the development unit 13 so that the mating relationship and contact relationship thereof with respect to the toner carrier 1 are satisfied. Finally, as shown in FIG. 13D, the holder 14 is fixed with a screw (the screw is not shown in the figure) to the development unit 13, and the electric mounting bases 4*a* are fixed (the fixing means is not shown in the figure) to the upper surface portion and lower surface portion of the development unit case 13*d*, so that the development unit 13 is sandwiched by the electric mounting bases 4*a* of the toner control means 4. With such a procedure, the mutual arrangement of the toner control means 4 and the toner carrier 1 is determined and the assembling of the printer unit 12 is completed so that the predetermined toner supply gap between the toner carrier 1 and the toner control means 4 is correctly formed.

Figure 14A:
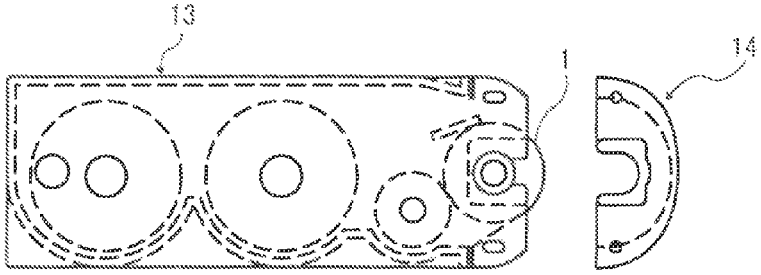
Figure 14B:
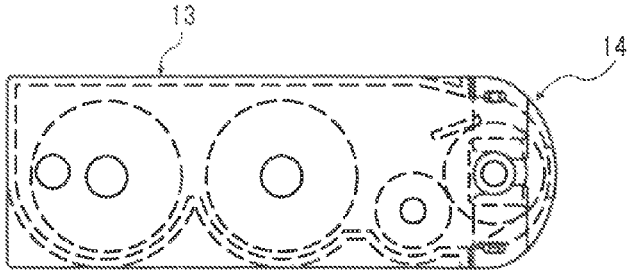
Figure 14C:
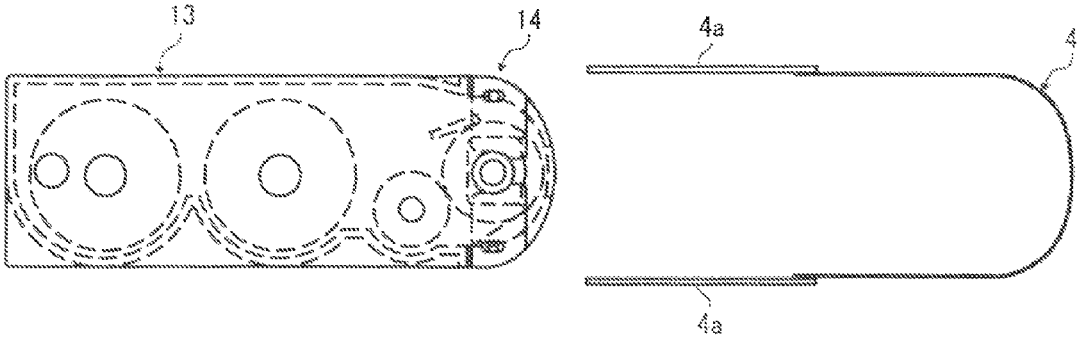
Figure 14D:
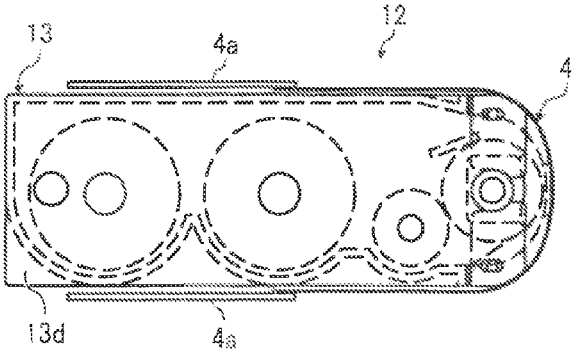

Further, another assembling procedure of the printer unit 12 is shown successively in FIGS. 14A, 14B, 14C, and 14D. FIG. 14D is identical to FIG. 10.

First, as shown FIG. 14A, the holder 14 and the development unit 13 are prepared. Then, as shown in FIG. 14B, the holder 14 is mounted as a single body on the development unit 13 and fixed thereto with a screw (the screw is not shown in the figure) to obtain the above-described mating relationship and contact relationship with respect to the toner carrier 1. Then, as shown in FIG. 14C, the toner control means 4 is prepared that is connected at both ends to the electric mounting bases 4*a*, the toner control means 4 is pasted to the holder 14, while being positioned with the reference pin 14*g* with respect to the holder 14, and the electric mounting bases 4*a* are fixed (the fixing means is omitted) to the development unit case 13*d*, thereby completing the assembling procedure of the printer unit 12 shown in FIG. 14D.

The printer units 12 assembled by the above-described two procedures can be disassembled by reversing the assembling procedures, and the development unit 13, holder 14, and toner control means 4 can be detached, replaced, and reused. However, because the toner control means 4 has a very low resistance to external forces, where the toner control means 4 is pasted to the holder 14 by using an adhesive material or a pressure-sensitive adhesive material, the toner control means 4 can be easily fractured when the toner control means 4 is peeled off from the holder 14, and the toner control means 4 that has been detached from the holder 14 is difficult to use. The replacement of the toner control means 4 at the holder 14 is conducted without any problem.

In a case where the toner control means 4 detached from the holder 14 is to be reused, it is preferred that a method be used by which the toner control means 4 is not pasted to the holder 14 with an adhesive material or a pressure-sensitive adhesive material, for example, the above-described method by which a tension is exerted on the toner control means 4 with a spring and the toner control means is brought into intimate contact with the holder 14.

Although there is no significant difference between the two above-described assembling procedures of the printer unit 12 and none of the assembling procedures is preferred to the other, from the standpoint of attaching the toner control means 4 to the holder 14, it is recommended that the procedure illustrated by FIG. 13 be used in a case of the printer unit 12 of a mode in which the toner control means 4 is pasted to the holder 14 with an adhesive material or a pressure-sensitive adhesive material, and the procedure illustrated by FIG. 14 be used in a case of the printer unit 12 of a mode in which the toner control means 4 is not pasted to the holder 14.

Example 2

Figure 15:
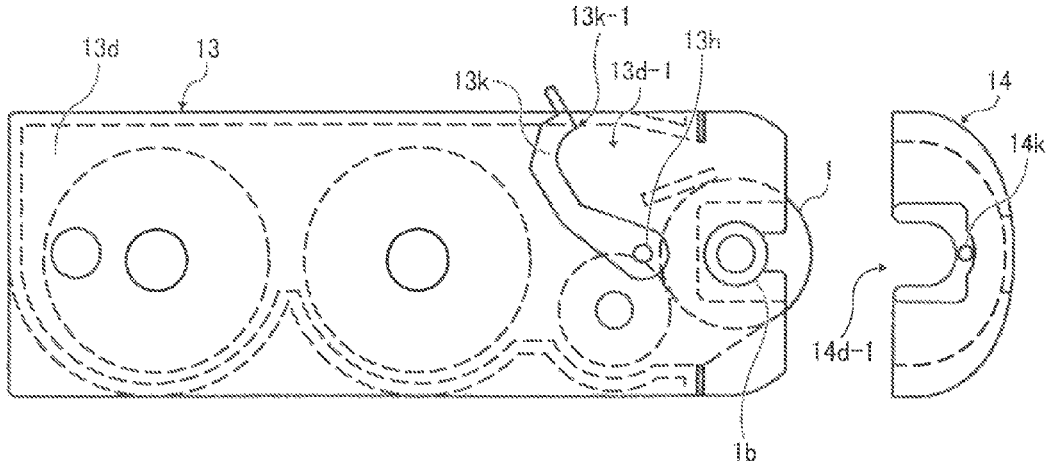
FIG. 15 and FIG. 16 illustrate a state in which the holder is not fixed to the development unit with a lever that fixes the holder to the development unit.
Figure 16:
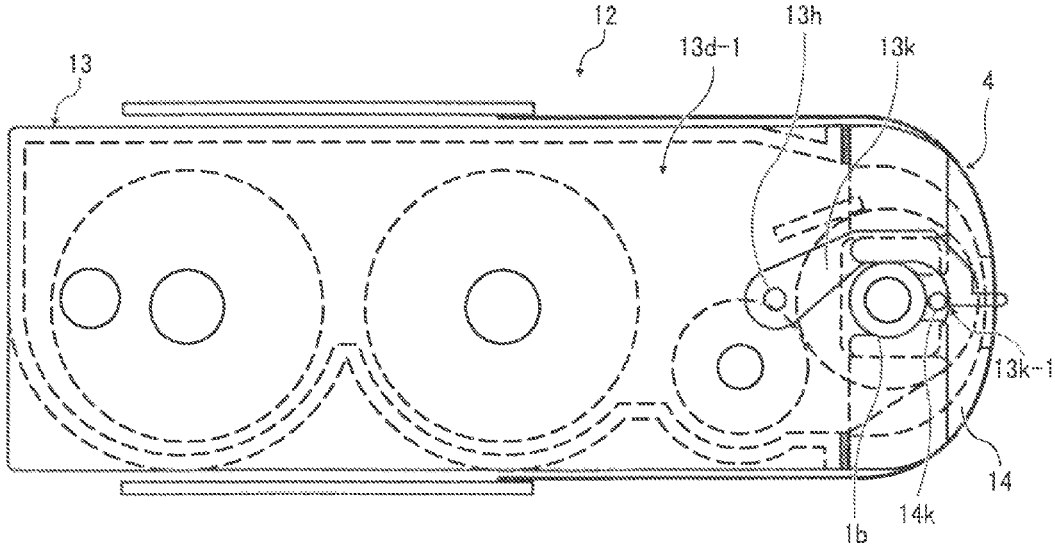

In the above-described example, a screw is used as a means for fixing the holder 14 to the development unit 13. An example of configuration using a fixing means employing a lever for efficiently conducting the assembling and disassembling operations of the printer unit 12 is illustrated by FIG. 15 and FIG. 16.

A lever 13*k* serving as a holder fixing means for pressing, mating, and fixing the bearing 1*b* of the toner carrier 1 to the bottom portion (abuts at the right side in the figure) of the U-shaped notch 14*d*-1 of the holder 14 is pivotally attached by a shaft 13*h* to the side plates 13*d*-1 (at the front side and deep side in the figures) of the development unit case 13*d*. A distal end portion 13*k*-1 of the lever 13*k* engages with a pin 14*k* embedded on the same central line as the U-shaped notch 14*d*-1 of the holder 14, and the engagement of the distal end portion 13*k*-1 of the lever 13*k* and the pin 14*k* generates a force that applies pressure to the bearing 1*b* and holds it in the U-shaped notch 14*d*-1. With such a configuration in which the holder 14 is fixed to the development unit 13 by using a fixing means with good operability and controllability, such as the lever 13*k*, it is possible to assemble and disassemble the printer unit 12 in a manner easier than that in the configuration using a spring as the fixing means when the holder 14 is fixed to the development unit 13.

Example 3

When the toner control means 4 or electric mounting base 4*a* is attached to the development unit 13 or holder 14, the surface thereof is exposed to the outside, and where the printer unit 12 is placed as a single unit on a working table or a floor, the exposed portion of the toner control means 4 or electric mounting base 4*a* can come into contact with the working table or floor, or with a foreign matter placed thereon. In the worst case, such a contact can fracture the toner control means 4 or electric mounting base 4*a*.

Figure 17:
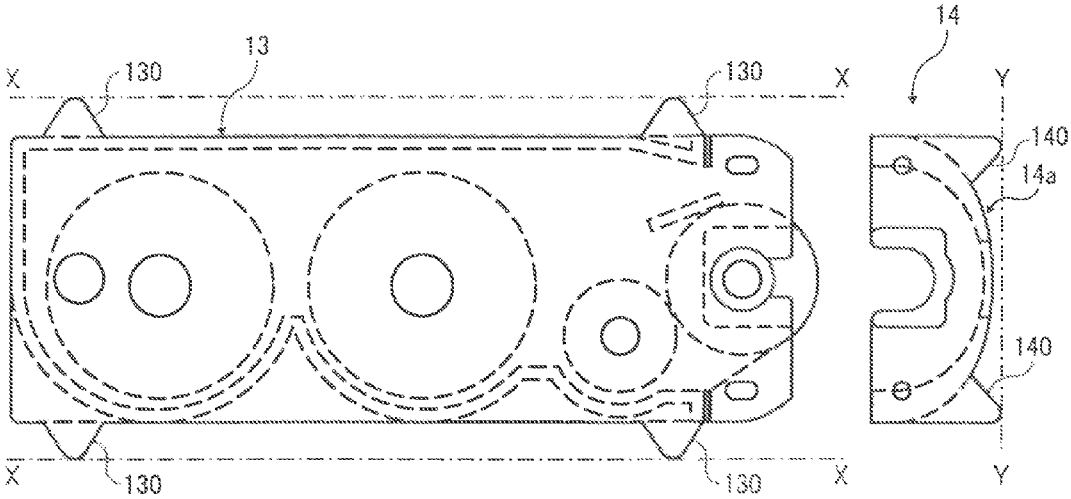
FIG. 17 and FIG. 18 illustrate a configuration of the printer unit according to Embodiment 1 in which protruding portions are provided at a side wall of the development unit and at a side wall of the holder.

Accordingly in the present embodiment, as shown in FIG. 17, protruding portions 130 and 140 that protrude to the outside from the surface of the toner control means 4 or electric mounting base 4*a* when the toner control means 4 or electric mounting base 4*a* is attached to the development unit 13 or holder 14 are formed at the development unit 13 and holder 14, thereby preventing the toner control means 4 or electric mounting base 4*a* from damage.

Thus, the protruding portions 140 that protrude from the vicinity of both ends so as to protect the side surface portion 14*a* at the right side in the figure that guides the formation of the surface shape (curved shape) of the toner control means 4 are formed at the holder 14, and the line Y-Y connecting the distal ends of the protruding portions 140 is positioned outside the source of the toner control means 4 when the toner control means 4 is attached.

Further, the protrusions 130 that protrude from the vicinity of both ends of the upper surface portion and lower surface portion of the development unit case 13*d* that fixes the electric mounting base 4*a* (including the toner control means 4) are formed at the development unit 13, and the lines X-X that connect the distal ends of these protruding portions 130 are positioned outside the surface of the electric mounting base 4*a* (including the toner control means 4) when the electric mounting base 4*a* (including the toner control means 4) is attached.

Figure 18:
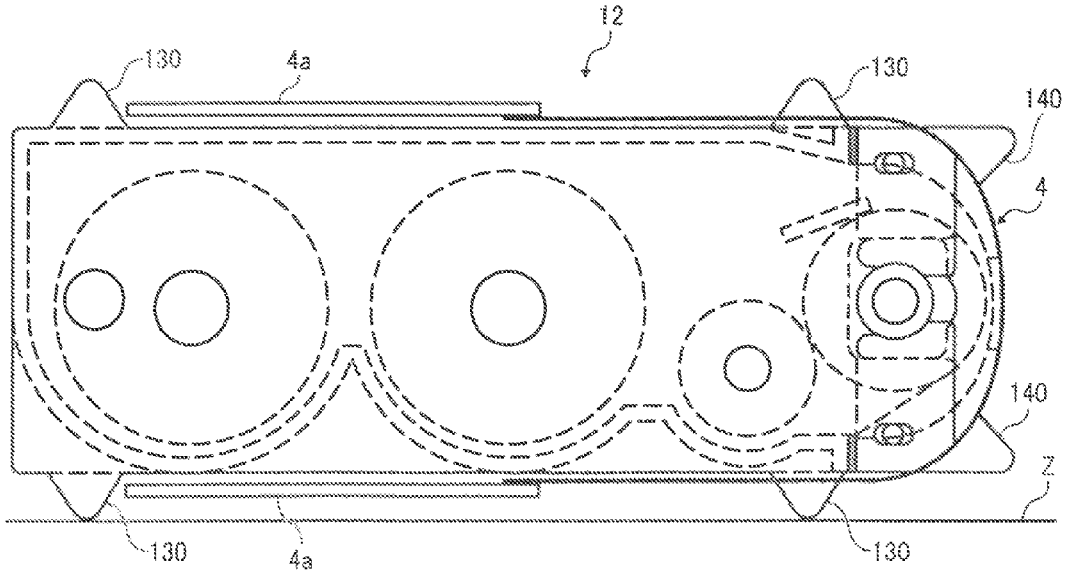
Figure 19:
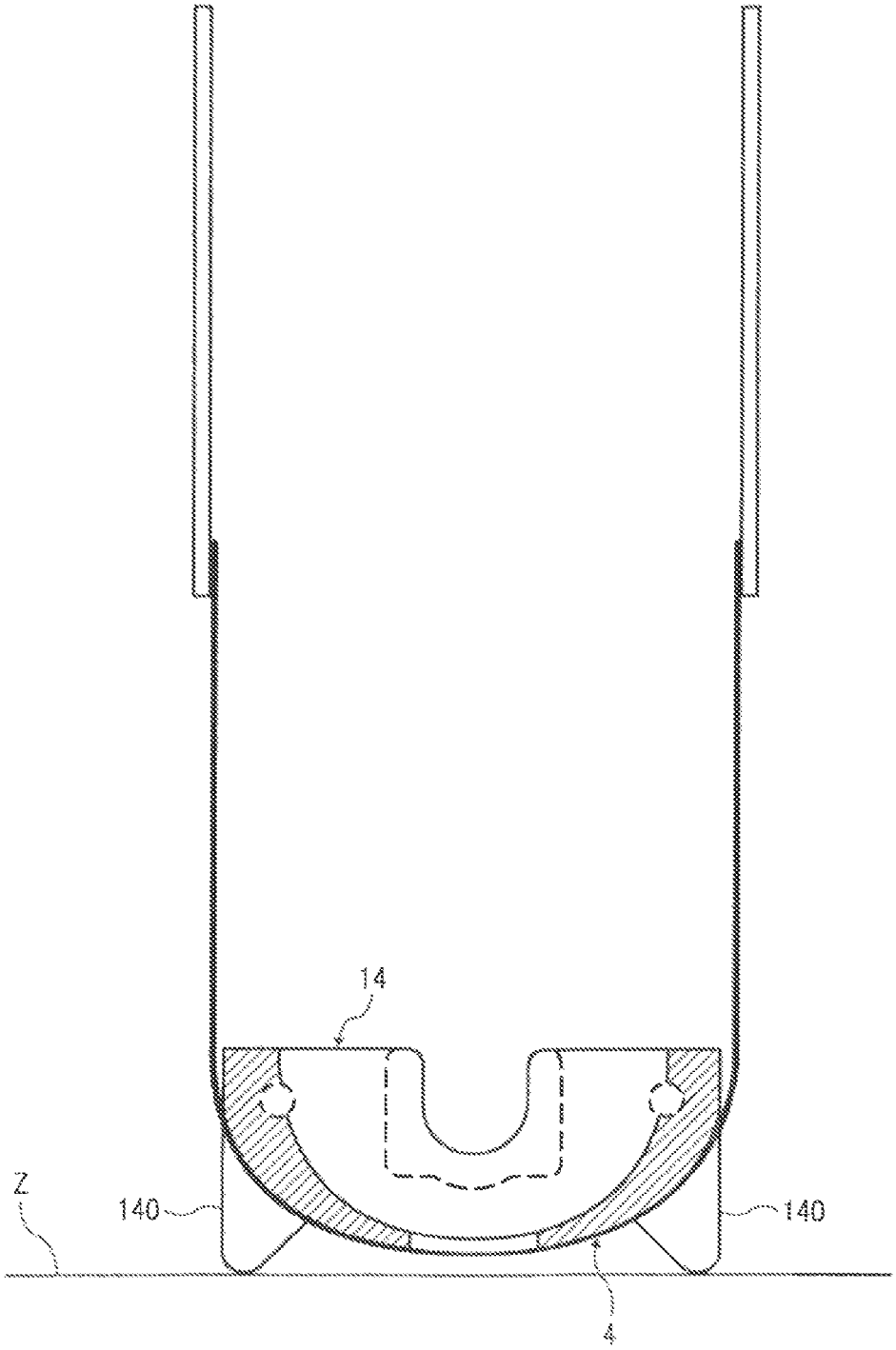
FIG. 19 illustrates a state in which a holder having formed therein the protruding portion that holds the toner control means is placed so that the toner passage holes face a disposition surface of an operation table.

FIG. 18 shows a state in which the printer unit 12 that uses the development unit 13 and holder 14 having the protrusions 130 and 140 formed thereon is placed on a working table Z. Further, when the holder 14 having the toner control means 4 pasted thereon has to be placed on the working table Z, as shown in FIG. 19 the holder is placed so that the toner passage holes 41 face down (so that they face the placement surface of the working table Z) in order to protect the toner passage holes 41 of the toner control means 4.

Embodiment 2

A color image forming apparatus of Embodiment 2 of the present invention that has installed therein the above-described printer unit 12 of Embodiment 1 will be described below.

Figure 20:
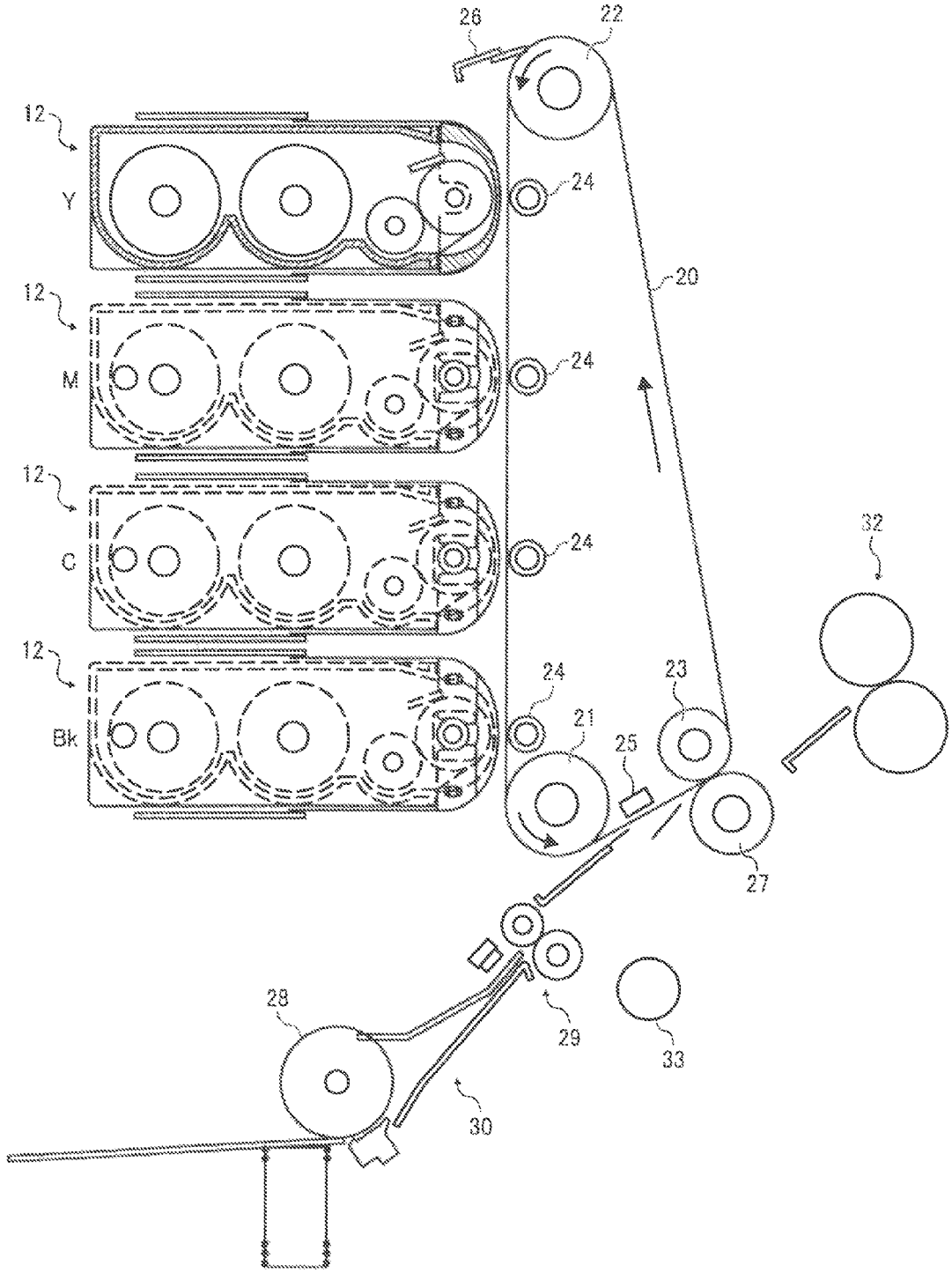
FIG. 20 illustrates a schematic configuration of a principal section of an image forming apparatus according to Embodiment 2 of the present invention.

FIG. 20 is a schematic side view illustrating the configuration of the image forming unit of the color image forming apparatus using an intermediate transfer belt 20 as a transfer medium. In this color image forming apparatus, toner images are formed on the intermediate transfer belt 20 by the printer units 12 of Embodiment 1 that generate toner clouds and perform the toner passage ON/OFF control with the toner control means 4. A color image is formed by successively overlapping the toner images for each color on the intermediate transfer belt 20 during one revolution of the intermediate transfer belt 20. Because the toner images of each color are directly overlapped on the intermediate transfer belt 20, the displacement can be reduced by comparison with that in an electrophotographic color image forming apparatus that uses a photosensitive body and an the intermediate transfer body.

In the image forming unit, the intermediate transfer belt 20 serving as a transfer image carrier is stretched over a drive roller 21, a tension roller 22, a transfer opposing roller 23, and opposing rollers 24 that are electrodes (back surface electrodes) on the intermediate transfer belt 20 side and used for toner control. In the present embodiment, the intermediate transfer belt is disposed almost vertically.

The intermediate transfer belt 20 is rotated in the counter-clockwise direction by a motor (not shown in the figure) connected to the drive roller 21. A total of four printer units 12 of each color that have identical configurations and differ in the color of the developer accommodated therein are stacked on the left side of the tensioned surface of the intermediate transfer belt 20, and the printer units are disposed successively with a predetermined spacing along the movement direction of the intermediate transfer belt 20.

The printer units 12 are disposed transversely with respect to the apparatus body. The opposing rollers 24 for corresponding colors are disposed opposite the printer units, with the intermediate transfer belt 20 being interposed therebetween, and the toner control means 4 of the printer units 12 are disposed at a predetermined distance (several hundreds of microns) called a printing gap from the intermediate transfer belt 20. The positions of the toner control means are printing positions.

A mark sensor 25 for generating a reference signal of image forming operation is disposed between the transfer opposing roller 23 and the transfer roller 27 that form the transfer unit, with the intermediate transfer belt 20 being interposed therebetween, or between the drive roller 21 and transfer opposing roller 23 inside the loop of the intermediate transfer belt 20.

Below the intermediate transfer belt 20, a paper feeding and conveying unit 30 composed of a paper feed roller 28 and a resist roller pair 29 is disposed on the carry-in side of the transfer unit and a fixing device 32 is disposed on the carry-out side of the transfer unit so that the paper conveying direction is inclined with respect to the transfer unit formed by the transfer roller 27 and the transfer opposing roller 23 that are disposed on both sides of the intermediate transfer belt 20. The color image forming apparatus body is provided with a rotary shaft 33, and the intermediate transfer belt 20, transfer unit, or fixing device 32 can be integrally withdrawn from the apparatus body, while leaving the printer unit 12 and paper feeding and conveying unit 30 inside the apparatus body (see FIG. 21).

The printer units 12 accommodate color toners of yellow (Y), magenta (M), cyan (C), and black (Bk) colors. In each of the printer units 12, the toner that has been converted into a toner cloud and moved to a position facing the toner control means 4 by the toner carrier 1 is selectively jetted out onto the intermediate transfer belt 20 by the control electric field of toner passage ON/OFF of the control electrode 42 in the position of toner passage holes 41 of the toner control means 4. The color toner images are then formed on the intermediate transfer belt 20 so that toner images of four colors overlap, and the overlapped toner image is transported to the transfer unit by the rotation of the intermediate transfer belt 20.

The paper conveying sequence is actuated in the paper feeding and conveying unit 30 synchronously with the above-described printing and imaging operations, and the paper is conveyed by the paper feed roller 28 and resist roller pair 29 and comes into contact along the surface of the intermediate transfer belt 20. The toner image and paper are matched in the transfer unit, and the entire four-color toner image located on the intermediate transfer belt 20 is transferred onto the paper by bias application to the transfer roller 27. The paper onto which image transfer has been completed is peeled off from the intermediate transfer belt 20 by a charge removing probe (not shown in the figure) and transported to the fixing device 32 where the toner image is fixed to the paper. The residual toner remaining on the intermediate transfer belt 20 after the transfer is cleaned with a cleaning means 26, and the intermediate transfer belt 20 is provided to form the next image.

In the color image forming apparatus of the present embodiment, a four-color toner image is formed by overlapping on the intermediate transfer belt 20 by the printer unit 12 and the color image is outputted by one revolution of the intermediate transfer belt 20. Therefore high-quality color images can be outputted at a high rate and the color image forming apparatus can be reduced in size.

Figure 21:
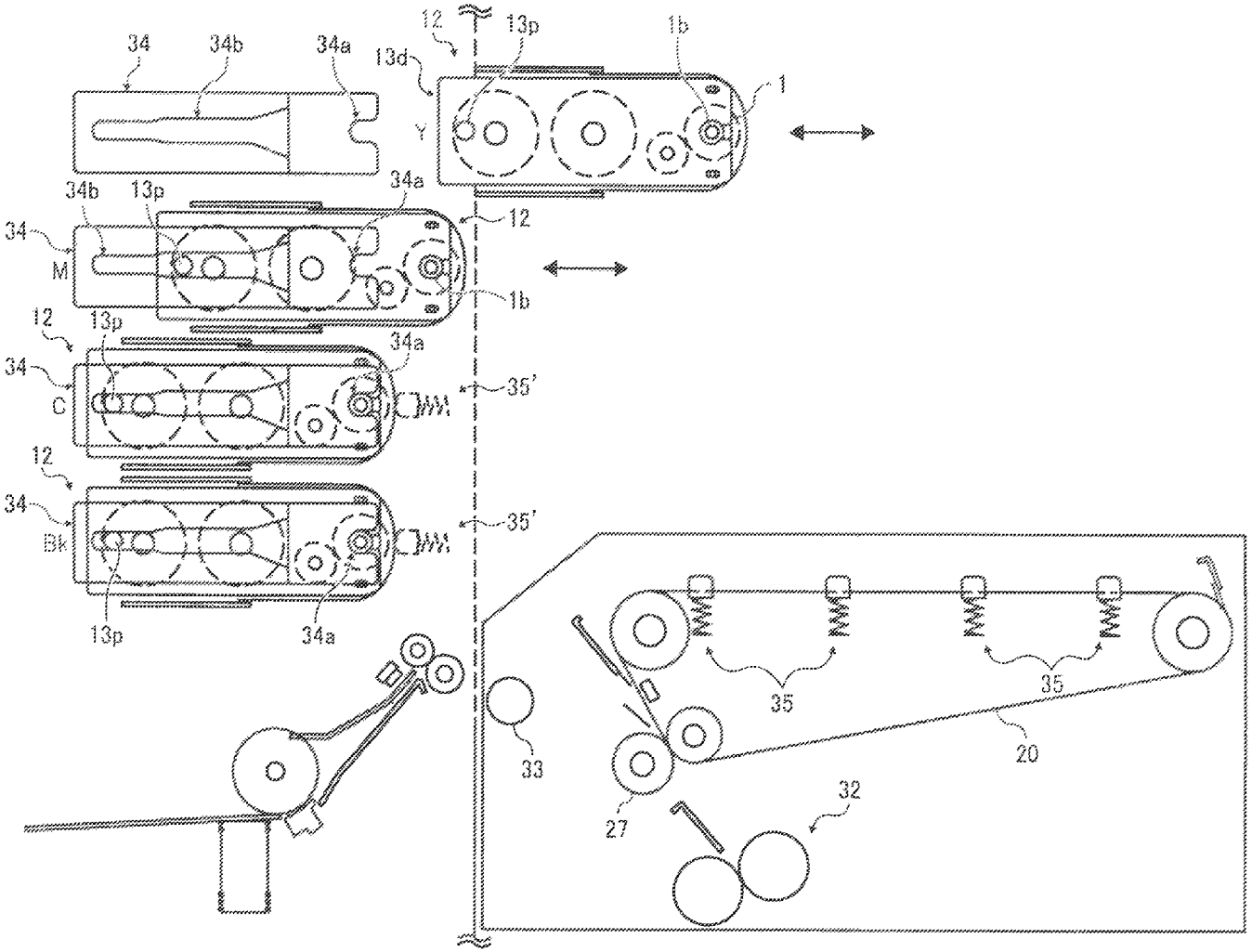
FIG. 21 illustrates a schematic configuration of a principal section of the image forming apparatus when the apparatus is opened to expose the printer unit according to Embodiment 2 of the present invention.

FIG. 21 illustrates a state in which the intermediate transfer belt 20, transfer unit, and fixing device 32 are integrally turned about the rotation axis 33 and withdrawn to open the apparatus so as to expose the printer units 12. In the present embodiment, the printer units 12 can be detached from the color image forming apparatus body and replaced in a simple manner. The printer units 12 is provided with a bracket 34 for each printer unit 12, the bracket supporting the printer unit 12 and holding it so that the printer unit can be attached and detached. As a result, the printer units 12 can be set into correct positions.

The position of the printer unit is set by mating the toner carrier bearing 1*b* of the printer unit 12 (development unit 13) with the U-shaped notch 34*a* provided at one end side of the bracket 34 and the printer unit is held by a pressure applied thereto by a pushing means 35 provided at the intermediate transfer belt 20 side. As a result, the printer unit 12 is positioned in the left-right direction and up-down direction as shown in the figure.

Where the positioning is performed only with the bearing 1*b* in the notch 34*a* of the bracket 34, the printer unit 12 can rotate about the bearing 1*b*. Therefore, a protruding shaft 13*p* is provided at the end portion of the side plate 13*d*-1 (end portion in a position opposite the bearing 1*b*) of the development unit case 13*d* in the printer units 12, and a groove 34*b* corresponding to the protruding shaft 13*p* is provided in the bracket 34 so as to extend along the attachment-detachment direction of the printer unit 12.

The end portion of the groove 34*b* in the attachment-detachment direction (left side in the figure) mates with the protruding shaft 13*p* in the up-down direction shown in the figure. Therefore, where the printer unit 12 is mounted on the bracket 34, the position of the printer unit 12 in the left-right direction and up-down direction is completely determined.

FIG. 21 shows a state immediately after the printer unit 12 of yellow (Y) color has been removed from the bracket 34 or immediately before the printer unit is to be mounted on the bracket. In this state, the printer unit 12 of magenta (M) color is being removed from the bracket 34 or mounted on the bracket, and the protruding shaft 13*p* is supported and guided by the groove 34*b*.

The printer units 12 of cyan (C) and black (Bk) colors are mounted on the respective brackets 34. In this state, pushing means 35' that are shown by dot lines in the figure push and hold these printer units 12 when the intermediate transfer belt 20 has been returned to the original position (position corresponding to a state in which image formation is possible). In a state in which the printer unit 12 is positioned and held by the pushing means 35, the printing gap that is a clearance between the toner control means 4 and the intermediate transfer belt 20 is ensured with good accuracy and stability.

In the present embodiment, a configuration is explained in which the printer units 12 are installed at the color image forming apparatus that uses the intermediate transfer belt 20, but the present invention is not limited to this configuration. For example, the printer unit can be also installed at a color image forming apparatus of a type in which toners of each color are transferred directly from the printer units 12 onto the paper, without using an intermediate transfer medium such as the intermediate transfer belt 20.

Figure 22:
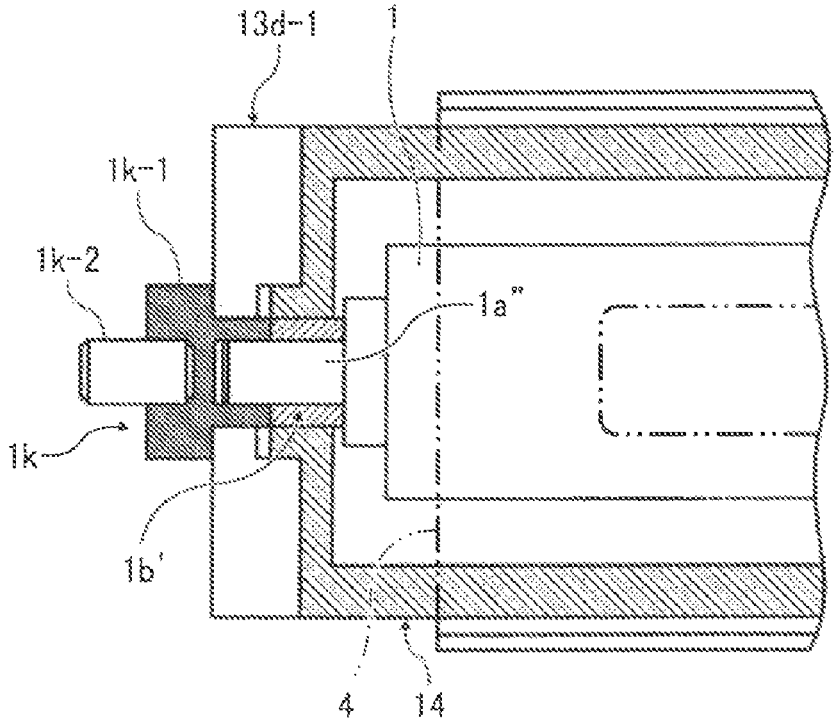
FIG. 22 is a cross-sectional view illustrating the vicinity of a mating portion of the holder and the development unit when the printer holder of Embodiment 2 is viewed from the front surface.

FIG. 22 shows an example of configuration in which a unit support member 1*k* that positions and supports the printer unit 12 at the bracket 34 is provided instead of the bearing 1*b* related to the shaft 1*a* of the toner carrier 1 of the printer unit 12 (development unit 13), such as shown in FIG. 8, that mates with the notch 34*a* of the bracket 34 when the printer unit 12 is positioned and supported with respect to the bracket 34. In the toner carrier 1, a plurality of electrodes are disposed side by side on the surface, a voltage is applied to each electrode via the shaft 1*a* or bearing 1*b*, and a toner cloud is generated. Therefore, it can be said that in the configuration such as shown in FIG. 8 in which the shaft 1*a* and bearing 1*b* are exposed, problems such as current leak, short circuit, and poor contact can easily occur.

Accordingly, as shown in FIG. 22, the shaft of the toner carrier 1 is produced as a short shaft 1*a*", the bearing is produced as a short bearing 1*b*' that mates only with the holder 14, and the shaft 1*a*" is supported by a unit support member 1*k* so as to hide the shaft 1*a*" and bearing 1*b*' from the outside. The unit support member 1*k* is composed of an electrically insulating bearing portion 1*k*-1 that has an orifice that rotatably supports the shaft 1*a*" as a bearing and a shaft 1*k*-2 that is supported by the bracket 34. Because the shaft 1*a*" and bearing 1*b*' are thus hidden by the unit support member 1*k* having the electrically insulating bearing portion 1*k*-1 so that the shaft and bearing are not exposed to the outside, the occurrence of the aforementioned current leak, short circuit, and poor contact can be inhibited.

(1) According to the above-described embodiments there is provided the printer unit 12 that includes the development unit case 13*d* that is a housing accommodating a developing agent composed at least of a toner that is an image forming agent, the toner carrier 1 that is rotatably supported by the development unit case 13*d*, faces outside the development unit case 13*d* from an opening formed in the development unit case 13*d*, and carries the developing agent accommodated inside the development unit case 13*d*, the insulating substrate 45 that is a sheet-like hole forming member having a plurality of toner passage holes 41 formed therein and installed so as to face the toner carrier 1 at a predetermined distance therefrom, the toner control means 4 composed at least of the plurality of control electrodes 42 that are jetting electrodes, provided at the insulating substrate 45 correspondingly to each of the plurality of passage holes 41, and form an electric field such that causes selectively the image forming agent to fly from the toner carrier 1 toward the toner passage hole 41, and in which an image is recorded by causing the toner in the developing agent that has been selectively jetted out from the toner carrier 1 by formation of the jetting electric field to adhere to the recording medium 3 that is the recording member on the basis of image information via the toner passage holes 41, the printer unit having the holder 14 that is a positioning member that is provided at the development unit case 13*d* so as to cover the toner carrier 1, holds the insulating substrate 45 of the toner control means 4 over the axial direction of the toner carrier by a side wall thereof that has open portions formed in locations at least opposing the plurality of toner passage holes 41 formed in the insulating substrate 45 of the toner control means 4, and positions the toner passage holes 41 relative to the toner carrier 1 so that the relative positions of the toner carrier 1 and the toner passage holes 41 of the toner control means 4 are in a predetermined mutual arrangement. In the present embodiment, the holder 14 holds the insulating substrate 45 of the toner control means 4 over the axial direction of the toner carrier by the side walls, thereby positioning the toner passage holes 41 relative to the toner carrier 1 so that the relative positions of the toner carrier 1 and the toner passage holes 41 of the toner control means 4 are in a predetermined mutual arrangement, in other words, so that toner supply gap that is a clearance between the toner carrier 1 and the insulating substrate 45 of the toner control means 4 has a predetermined value. Because the holder 14 thus holds the insulating substrate 45 of the toner control means 4 over the axial direction of the toner carrier by the side walls, deflections such that result in a spread in the toner supply gap in the axial direction of the toner carrier are prevented from occurring in the insulating substrate 45 of the toner control means 4, by contrast with a configuration in which the insulating substrate 45 of the toner control means 4 is held by the holder 14 only at both ends in the axial direction of the toner carrier. Therefore, the spread of the toner supply gap that is a clearance between the toner carrier 1 and the toner passage holes 41 in the axial direction of the toner carrier can be inhibited and the predetermined value of the toner supply gap can be maintained.

(2) Further, according to the above-described embodiments, the holder 14 is configured to be capable of attaching as an independent unit to and detaching from the development unit case 13*d* or be capable of attaching to and detaching from the development unit case 13*d* in a state in which the insulating substrate 45 of the toner control means 4 is installed along the side wall, and configured so that when the holder 14 is mounted on the development unit case 13*d*, positioning of the holder 14 with respect to the development unit case 13*d* is conducted by engaging an engaging portion provided at a shaft of the toner carrier 1 or a bearing member related to the toner carrier 1 and an engaged portion provided at the holder 14, whereby it is possible to attach or detach constitutional components of the printer units 12 for replacement or for reuse while the holder 14 enables the relative positions of the toner carrier 1 and the toner passage holes to have a predetermined positional relationship.

(3) Further, according to the above-described embodiments, by using a ball bearing as a bearing member related to the toner carrier 1, it is possible to set with high accuracy the mutual arrangement of the toner carrier 1 and the holder 14 that enables the above-described attachment and detachment. Therefore, the toner supply gap can be set and maintained with high accuracy.

(4) Further, according to the above-described embodiments, where the direct image-recording device has the lever 13*k* that is the lever member provided rotatably with respect to the development unit case 13*d*, so that the engaging portion thereof can be engaged with the second engaged portion provided at the holder 14 and disengaged therefrom. As a result, as described hereinabove, assembling and disassembling of the printer unit can be easily performed.

(5) Further, according to the above-described embodiments, the electric mounting base 4*a* that is an electric mounting member for driving and controlling the control electrodes 42 is provided at an end portion of the insulating substrate 45 of the toner control means 4 in electric connection with the control electrode 42 and the electric mounting base 4*a* is attached to the development unit case 13*d*, thereby providing a compact and easily handleable printer unit 12 and making it possible to reduce the size of the image forming apparatus that has the printer unit 12 installed therein.

(6) Further, according to the above-described embodiments, a protruding portion that protrudes outward from a surface of the toner control means 4 when the toner control means 4 is attached to the side wall of the holder 14 is formed at the holder 14, thereby making it possible to reduce the possibility of damaging the toner control means 4 by contact with a foreign matter or the operation table with the exposed portion of the toner control means 4.

(7) Further, according to the above-described embodiments, a protruding portion that protrudes outward from a surface of the toner control means 4 when the toner control means 4 is attached to the side wall of the holder 14 and from the surface of the electric mounting base 4*a* when the electric mounting base 4*a* is attached to the development unit case 13*d* is formed at the development unit case 13*d*, thereby making it possible to reduce the possibility of damaging the toner control means 4 and the electric mounting base 4*a* by contact of the exposed portion of the toner control means 4 and the electric mounting base 4*a* with a foreign matter or the operation table.

(8) Further, according to the above-described embodiments, the development unit 12 is itself configured to be capable of attaching to and detaching from an image forming apparatus body that has the development unit 12 installed thereon, and a positioning reference member serving as a reference in positioning with the image forming apparatus body is provided at the development unit case 13*d*. As a result, the printer unit 12 can be positioned with high accuracy with respect to the image forming apparatus. Therefore, the printing gap between the toner control means 4 and a transfer medium such as an intermediate transfer belt 20 can be ensured stably and with good accuracy and a high-quality image can be provided.

(9) Further, according to the above-described embodiments, the positioning reference member provided at the development unit case 13*d* is at least the bearing member related to the toner carrier 1 or a support member provided at the same axial line with the shaft of the toner carrier 1, thereby making it possible to position the printer unit 12 with high accuracy with respect to the image forming apparatus. Therefore, the printing gap between the toner control means 4 and a transfer medium such as an intermediate transfer belt 20 can be ensured stably and with good accuracy and a high-quality image can be provided.

(10) Further, according to the above-described embodiments, the holder 14 is a cover member that is provided at the development unit case 13*d* so as to cover an opening formed in the development unit case 13*d* and has formed therein a second opening in a location opposite the toner carrier 1, and the positioning member is configured so as to hold the toner control means 4 along the side surface portion 14*a* that is an outer circumferential surface of the side wall where the second opening is formed. As a result, the toner control means 4 is positioned by the holder 14 with respect to the toner carrier 1 and a function of preventing the developer accommodated inside the development unit case 13*d* from scattering to the outside from the opening formed in the development unit case 13*d* is realized.

(11) Further, according to the above-described embodiments, by installing the printer unit 12 in accordance with the present invention at a color image forming apparatus it is possible to output high-quality color images at a high rate and reduce the size of the color image forming apparatus.

The present invention demonstrates an excellent effect of making it possible to set and maintain the predetermined gap between the agent carrier and the hole forming member. Thus, because the positioning member holds the hole forming member over the axial direction of the agent carrier by the side walls, the deflection such that causes a spread in the gap in the axial direction of the agent carrier can be inhibited better than in the configuration in which the holder forming member is held by the positioning member only at both ends in the axial direction of the agent carrier. Therefore, the spread of the gap between the agent carrier and the hole forming member in the axial direction of the agent carrier can be inhibited and the predetermined gas can be maintained.

Various modifications will become possible for those skilled in the art after receiving the teachings of the present disclosure without departing from the scope thereof.

What is claimed is:

1. A direct image-recording device comprising:

a housing that accommodates an image forming agent;

an agent carrier that is rotatably supported by the housing, faces outside of the housing from an opening formed in the housing, and carries the image agent accommodated inside the housing;

a sheet-like hole forming member having a plurality of holes formed therein and installed so as to face the agent carrier at a predetermined distance therefrom;

a plurality of electrodes by which the image forming agent flies provided at the hole forming member correspondingly to each of the plurality of holes and form an electric field to cause selectively the image forming agent to fly from the agent carrier toward the holes; and a positioning member that is provided at the housing so as to cover the agent carrier that forms, on the basis of image information, an image by causing the image forming agent that is caused to fly selectively from the agent carrier to adhere, via the holes, to a recording member due to formation of the electric field, by which the image forming agent flies, the positioning member being configured to hold the hole forming member along an axial direction of the agent carrier by a side wall of the positioning member that has open portions formed in locations at least opposing the plurality of holes formed in the hole forming member, and configured to position the hole forming member relative to the agent carrier so that the relative positions of the agent carrier and the hole forming member are in a predetermined positional relationship.

2. The direct image-recording device as claimed in claim 1, wherein the positioning member is configured to be capable of attaching or detaching, as an independent unit, to/from the housing or be capable of attaching or detaching to/from the housing in a state in which the hole forming member is installed along the side wall, and configured so that when the positioning member is attached to the housing, positioning of the positioning member with respect to the housing is conducted by engaging an engaging portion provided at a shaft of the agent carrier or a bearing member supporting the agent carrier and an engaged portion provided at the positioning member.

3. The direct image-recording device as claimed in claim 2, wherein a ball bearing is used as the bearing member supporting the agent carrier.

4. The direct image-recording device as claimed in claim 2, further comprising a lever member that is provided rotatably with respect to the housing, so that a second engaged portion provided at the positioning member can be engaged with or disengaged from an engaging portion of the second engaged portion.

5. The direct image-recording device as claimed in claim 1, further comprising an electric mounting member that is provided at an end portion of the hole forming member in electric connection with the electrode, by which the image forming agent flies, and drives and controls the electrode, the electric mounting member being attached to the housing.

6. The direct image-recording device as claimed in claim 1, wherein a protruding portion, which protrudes outward from a surface of the hole forming member when the hole forming member is attached to the side wall of the positioning member, is formed at the positioning member.

7. The direct image-recording device as claimed in claim 1, wherein a protrusion portion, which protrudes outward from the surface of the hole forming member when the hole forming member is attached to the side wall of the positioning member and from the surface of the electric mounting member when the electric mounting member, is attached to the housing is formed at the housing.

8. The direct image-recording device as claimed in claim 1, wherein the direct image-recording device is configured to be capable of attaching or detaching to/from an image forming apparatus body having the direct image-recording device installed thereon, and a positioning reference member serving as a reference in positioning with respect to the image forming apparatus is provided at the housing.

9. The direct image-recording device as claimed in claim 8, wherein the positioning reference member provided at the housing is at least a bearing member supporting the agent carrier or a support member provided at the same axial line as that of the shaft of the agent carrier.

10. The direct image-recording device as claimed in claim 1, wherein the positioning member is a cover member that is provided at the housing so as to cover an opening formed in the housing and has formed therein a second opening in a location opposite the agent carrier, the positioning member being configured so as to hold the hole forming member along an outer circumferential surface of the side wall where the second opening of the cover member is formed.

11. The direct image-recording device as claimed in claim 1, further comprising a counter electrode that is installed so as to face the agent carrier, with the hole forming member being interposed therebetween, the counter electrode serving to form an electric field by which the image forming agent flying from the agent carrier is attracted.

12. An image forming apparatus having a direct image-recording device, the direct image-recording device comprising:

a housing that accommodates an image forming agent;

an agent carrier that is rotatably supported by the housing, faces outside of the housing from an opening formed in the housing, and carries the image agent accommodated inside the housing;

a sheet-like hole forming member having a plurality of holes formed therein and installed so as to face the agent carrier at a predetermined distance therefrom;

a plurality of electrodes by which the image forming agent flies provided at the hole forming member correspondingly to each of the plurality of holes and form an electric field to cause selectively the image forming agent to fly from the agent carrier toward the holes; and a positioning member that is provided at the housing so as to cover the agent carrier that forms, on the basis of image information, an image by causing the image forming agent that is caused to fly selectively from the agent carrier to adhere, via the holes, to a recording member due to formation of the electric field, by which the image forming agent flies, the positioning member being configured to hold the hole forming member along an axial direction of the agent carrier by a side wall of the positioning member that has open portions formed in locations at least opposing the plurality of holes formed in the hole forming member, and configured to position the hole forming member relative to the agent carrier so that the relative positions of the agent carrier and the hole forming member are in a predetermined positional relationship.

* * * * *